US005088507A

United States Patent [19]

Baker et al.

[11] Patent Number: 5,088,507

[45] Date of Patent: Feb. 18, 1992

[54] APPARATUS FOR ASSEMBLING COMPONENTS OF A SMOKING ARTICLE

[75] Inventors: Max N. Baker, Rural Hall; Douglas C. Clark, Winston-Salem, both of N.C.

[73] Assignee: R. J. Reynolds Tobacco Company, Winston-Salem, N.C.

[21] Appl. No.: 75,001

[22] Filed: Jul. 17, 1987

[51] Int. Cl.[5] ..... A24C 5/00

[52] U.S. Cl. ..... 131/280; 131/282; 131/70; 131/72; 131/77; 131/78; 131/94

[58] Field of Search ..... 131/70, 280, 282, 72, 131/77, 94, 78

[56] References Cited

U.S. PATENT DOCUMENTS

| | | | |
|---|---|---|---|
| Re. 25,917 | 11/1965 | Stelzer . | |
| 1,559,322 | 10/1925 | Hohn . | |
| 3,036,581 | 5/1962 | Dearsley . | |
| 3,096,772 | 7/1963 | Korber . | |
| 3,199,418 | 8/1965 | Schubert . | |
| 3,199,515 | 10/1965 | Lowe . | |
| 3,362,413 | 1/1968 | Redford . | |
| 3,368,460 | 2/1968 | Schubert . | |
| 3,513,856 | 5/1970 | Sexstone . | |
| 3,736,941 | 6/1973 | Molins et al. . | |
| 3,822,710 | 7/1974 | Bramhill | 131/70 |
| 3,840,028 | 8/1974 | Yatrides . | |
| 3,957,062 | 5/1976 | Labbe et al. . | |
| 3,987,804 | 10/1976 | Molins et al. . | |
| 4,200,179 | 4/1980 | Hinz . | |
| 4,207,720 | 6/1980 | Tolasch et al. . | |
| 4,237,778 | 12/1980 | Hausler et al. . | |
| 4,238,994 | 12/1980 | Koch . | |
| 4,487,001 | 12/1984 | Tolasch et al. . | |
| 4,489,534 | 12/1984 | Gomann et al. . | |
| 4,714,082 | 12/1987 | Banerjee et al. . | |

FOREIGN PATENT DOCUMENTS

| | | |
|---|---|---|
| 0174645 | 3/1986 | European Pat. Off. . |
| 0212234 | 3/1987 | European Pat. Off. . |
| 102229 | 9/1897 | Fed. Rep. of Germany . |
| 2715994 | 10/1986 | Fed. Rep. of Germany . |
| 1017181 | 3/1968 | United Kingdom . |

OTHER PUBLICATIONS

Hauni-Werke Korber & Co. KG, Hamburg, Germany Brochure No. 1 Re: Cigarette Manufacture, 1983 Edition.

Hauni-Werke Korber & Co. KG, Hamburg, Germany Brochure No. 2 Re: Filter Rod Production, 1983 Edition.

Hauni-Werke Korber & Co. KG, Hamburg, Germany Brochure No. 3 Re: Transfer Systems, 1983 Edition.

*Primary Examiner*—V. Millin

*Attorney, Agent, or Firm*—Grover M. Myers; David G. Conlin

[57] ABSTRACT

Apparatus is described for inserting a component comprising an elongate cartridge containing an aerosol forming material, at one end of which there is a fuel element, within a jacket component comprising a rod, a sleeve of insulating material, or a combination thereof, the apparatus preferably providing for forming a passage in the jacket component and inserting the elongate cartridge therein. Preferably, the apparatus comprises a plurality of movably mounted stations for high speed manufacture of smoking articles.

80 Claims, 16 Drawing Sheets

APPARATUS FOR ASSEMBLING COMPONENTS OF A SMOKING ARTICLE

BACKGROUND OF THE INVENTION

In European Patent Publications 0174645(A2) and 0212234(A2), the disclosures of which are hereby incorporated by reference, there are disclosed a number of alternative forms of smoking articles which typically embody (1) an aerosol generating cartridge comprising a fuel element for generating heat for transfer to an aerosol forming material which may contain a tobacco flavoring material, (2) a sleeve or jacket circumscribing the cartridge, the sleeve preferably including an insulating material around the fuel element and a tobacco containing material around the aerosol forming material and, optionally, (3) a mouthend piece, which may contain a filter element. Generally, the aerosol generating cartridge comprises a capsule containing an aerosol generating material with a fuel element at one end.

It is a purpose of this invention to provide an apparatus for incorporating such an aerosol generating cartridge into the sleeve to form an aerosol generating module for use in a smoking article such as, for example, a cigarette type smoking article.

SUMMARY OF THE INVENTION

In accord with the present invention, an apparatus for making a module, preferably an aerosol generating module, for smoking articles is provided. The apparatus comprises means for holding a jacket segment, means for holding a capsule or cartridge, preferably in axial alignment with the jacket segment, and means for inserting the cartridge into the jacket segment, thereby forming a module for smoking articles, preferably an aerosol generating module.

In certain preferred embodiments in which the jacket segment comprises a sleeve of material preformed around a support member, such as a tube, the apparatus includes means for ejecting the support member from the jacket segment, preferably while an aerosol generating cartridge is being inserted into the jacket segment.

In another preferred embodiment, the apparatus further comprises means for forming a passage lengthwise in the jacket segment, and the aerosol generating cartridge is inserted into the passage.

In a particularly preferred embodiment, the passage is formed in the jacket segment by a passage forming member and the apparatus has means for withdrawing the passage forming member and simultaneously inserting the aerosol generating cartridge. In instances where a portion of the jacket segment is formed around a support member, such as a tube, the withdrawing and inserting means also preferably includes means for ejecting the support member from the jacket segment while the cartridge is being inserted.

In one preferred embodiment, an apparatus in accord with the present invention comprises a spindle, an abutment member spaced from and in axial alignment with the spindle, and a slidably mounted carriage having aligned recesses disposed between the spindle and abutment member for supporting the jacket segment and the aerosol generating cartridge in alignment with the spindle and abutment member. The recess for the jacket segment is located proximal to the spindle and the recess for the cartridge is located between the jacket segment recess and the abutment member. Preferably, the abutment member is slidably mounted on the carriage and is movable in unison with the carriage and also relative thereto.

This preferred apparatus also includes means for effecting concurrent movement of the carriage and abutment member toward the spindle to impale the jacket segment on the spindle to thus form a passage longitudinally therein, means operable to restrain retraction of the abutment member after the jacket segment has been impaled on the spindle, and means for effecting movement of the carriage away from the spindle and toward the abutment member to remove the jacket segment from the spindle, engage the cartridge with the abutment member and move the jacket segment to impale it on the cartridge. Preferably, during this motion which accomplishes the insertion of the cartridge into the jacket segment, any support member within the jacket segment is ejected at the spindle end thereof.

Desirably, the spindle is rotatable about its longitudinal axis and a clamp means is provided for restraining the jacket segment in its recess while the jacket segment is being impaled on the rotating spindle and on the cartridge. Reciprocal movement of the carriage is effected by suitable linkages.

Preferably, the apparatus also has releasable latch means, to prevent movement of the abutment member relative to the carriage while the jacket segment is moved over the cartridge.

An apparatus in accord with a highly preferred embodiment of the invention comprises (1) a plurality of movably mounted stations, each station comprising jacket holding means for receiving and holding at least one jacket segment, and cartridge holding means for receiving and holding at least one cartridge or capsule, and (2) means for inserting cartridges into jacket segments, thereby forming modules for smoking articles. Preferably, the jacket segment comprises tobacco and the cartridge contains an aerosol generating material. In certain preferred embodiments, the apparatus also is provided with a passage forming member to form a longitudinal passage in at least a portion of the jacket segment. Typically, the apparatus comprises jacket supply means for supplying jacket segments and cartridge supply means for supplying aerosol generating cartridges to the movably mounted stations and means for removing the aerosol generating modules from each of the stations, in seriatim. The stations move in sequence forming a track of stations and, preferably, each station forms a plurality of aerosol generating modules in parallel.

In one preferred embodiment of the invention, the stations are mounted on a rotatable member, such as a rotating table or, preferably, a drum.

Apparatus in accord with the present invention may additionally comprise means for supplying a mouthend piece and means for joining the mouthend piece to the aerosol generating module to form a cigarette type smoking article.

BRIEF DESCRIPTION OF THE DRAWINGS

The invention will now be described in greater detail with respect to the accompanying drawings, wherein.

DETAILED DESCRIPTION OF THE PREFERRED EMBODIMENTS

Figure 1:
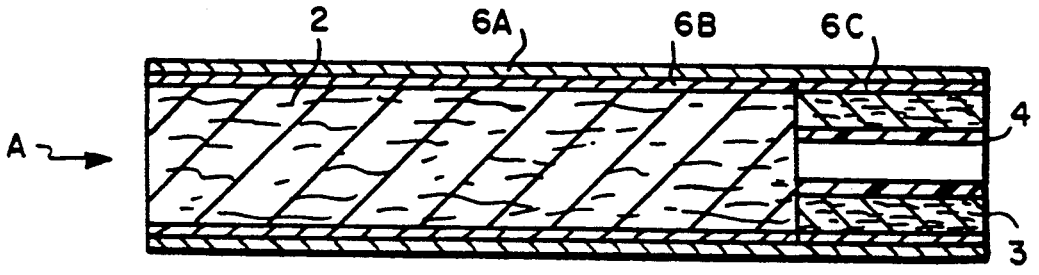
FIG. 1 is a longitudinal cross section of one embodiment of a jacket segment "A" useful in the practice of this invention.
Figure 2:
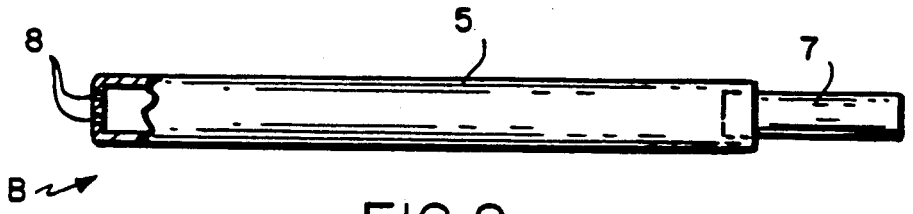
FIG. 2 is an elevation, partly in section, of an embodiment of an aerosol generating cartridge "B" useful in the practice of this invention.
Figure 3:
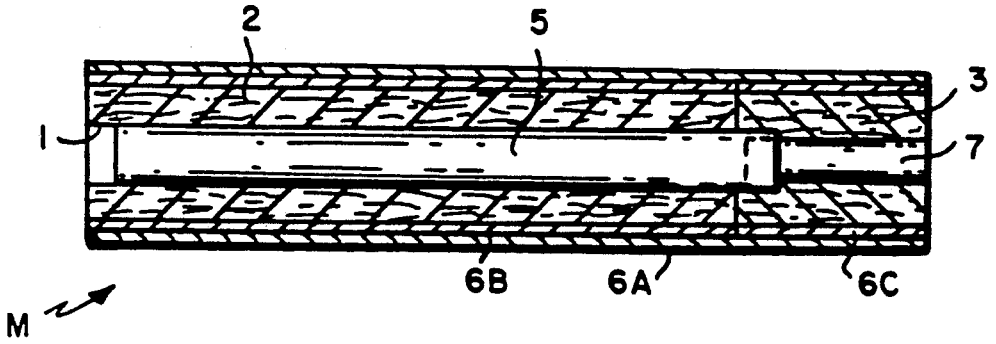
FIG. 3 is a view, partly in section, showing the cartridge of FIG. 2 incorporated in the jacket segment of FIG. 1, thus forming an aerosol generating module "M"

Referring to the drawings, FIGS. 1, 2, and 3, and in accordance with the invention, a preferred apparatus is structured to form a longitudinal opening or axial passage 1 (FIG. 3) in an elongate jacket segment "A" (Component "A") and insert in opening 1 an aerosol generating cartridge "B" (Component "B"). As illustrated in FIG. 1, a preferred jacket segment "A" comprises a rod 2 of fibrous material such as tobacco, volume expanded tobacco, reconstituted tobacco materials, combinations thereof, or other materials. At one end of rod 2 there is a sleeve 3 of insulating material, in this case non-combustible fibers, such as glass fibers. Within the sleeve, there is a tubular support member 4. The rod 2 and sleeve 3 are joined by means of paper wrappers 6A, 6B, and 6C, such as customarily used in the manufacture of smoking articles such as cigarettes.

Although the jacket segment "A" illustrated in FIG. 1 comprises a preformed sleeve portion and a rod of fibrous material portion, jacket segments for smoking articles may also comprise (1) only a sleeve portion preformed about a support member, (2) a sleeve without a support member, (3) only a rod, or (4) other variations having portions that comprise a preformed sleeve, a rod, or combinations thereof. In such cases, the apparatus of the present invention can be modified accordingly. For instance, if the jacket segment comprises only a rod portion, a spindle or other passage forming means would normally be used to form a passage suitable for inserting the cartridge therein, or the cartridge may be configured to form a passage as it is inserted. If the jacket segment comprises only a sleeve portion, the apparatus of the invention would be modified to eliminate the spindle and, if required, to eject any support member, preferably as the aerosol generating cartridge is inserted into the jacket segment.

The preferred aerosol generating cartridge "B" (FIG. 2) is an elongate capsule 5, advantageously of circular cross section, containing an aerosol forming material and having one or more holes 8 at one and for release of aerosol. A fuel element 7, preferably in the form of a carbon plug, is inserted in the other end of capsule 5. Other configurations of the aerosol generating cartridge, such as the various aerosol generating means described in the aforesaid European Patent Publications, may also be used. Also, any means for generating heat to produce an aerosol can be substituted for the fuel element.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating cartridge or capsule, or elsewhere in the article. As so defined, the term aerosol" also includes volatile or sublimeable flavoring agents and/or pharmacologically or physiologically active agents, irrespective of whether they produce a visible aerosol.

The preferred apparatus described herein are designed to make the longitudinal opening 1 in jacket segment "A" and insert cartridge "B" therein, thereby forming an aerosol generating module "M" as illustrated in FIG. 3.

Figure 4:
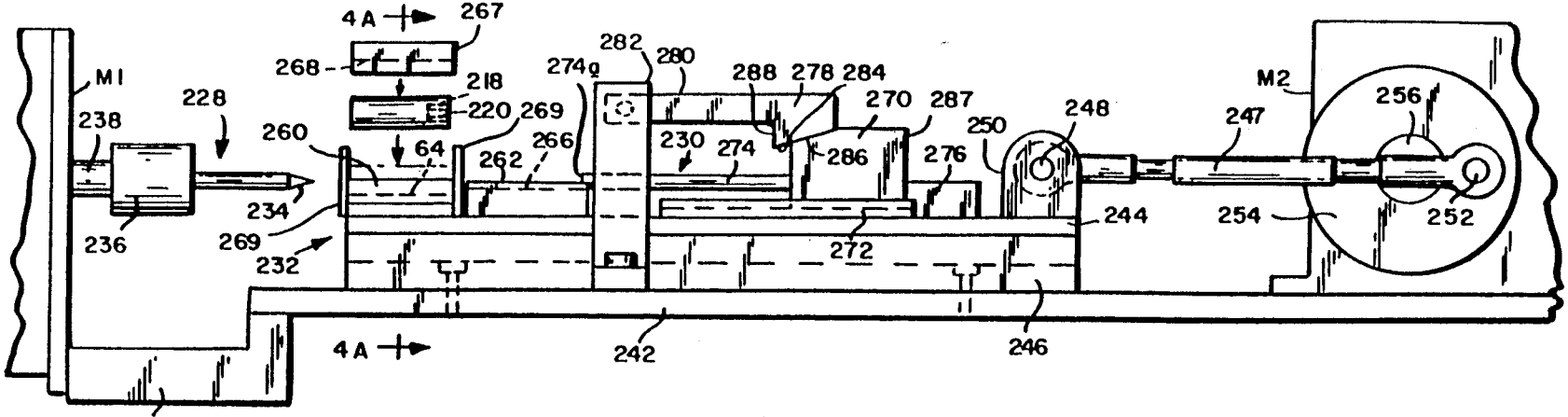
FIG. 4 is a side elevation of one embodiment of an apparatus according to this invention, showing the deposit of a jacket segment on the carriage.
Figure 7A:
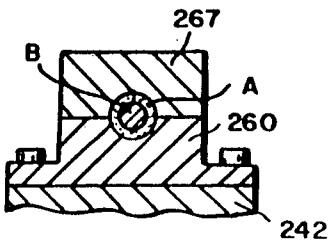
FIG. 7A is a transverse section taken on the line 7A—7A of FIG. 7 showing the jacket segment disposed around the cartridge.
Figure 5:
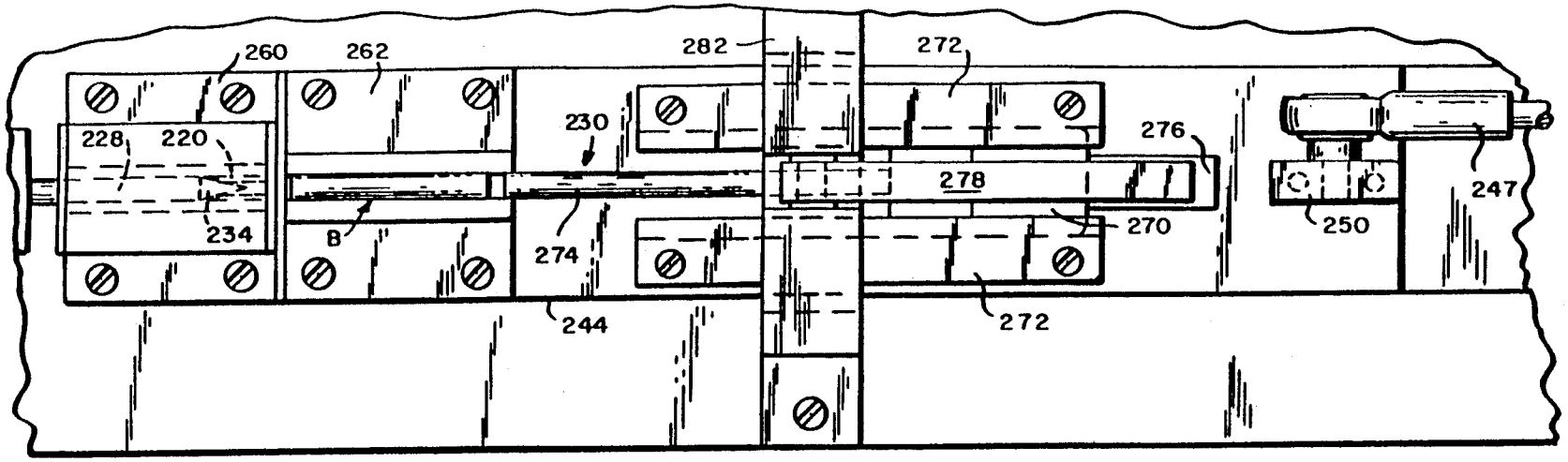
FIG. 5 is a fragmentary plan view of FIG. 4 to larger scale showing the jacket segment impaled on the spindle with the deposit of the cartridge in its recess in the advanced position of the carriage.

The apparatus illustrated in FIGS. 4 to 7B is intended to assemble one aerosol generating module at a time. Referring to FIGS. 4 and 5, the illustrated apparatus comprises essentially a spindle 228, a support means or carriage 232, and a cylindrical abutment member 230 mounted on the carriage in axial alignment with the spindle. The carriage 232 is structured to support the jacket segment "A" at 260 and the cartridge "B" at 262 in alignment with each other and with the spindle and abutment member.

The spindle 228 is of circular cross section and has at one end a conical tip 234. It is fixed at its other end to a chuck 236 mounted to a shaft 238 which is rotated by a motor M1. The motor M1 is supported by a bracket 240 bolted to platform 242.

Figure 4B:
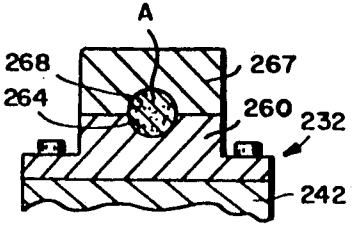
FIG. 4B is a transverse section showing the clamp engaged with the support for the jacket segment.
Figure 4A:
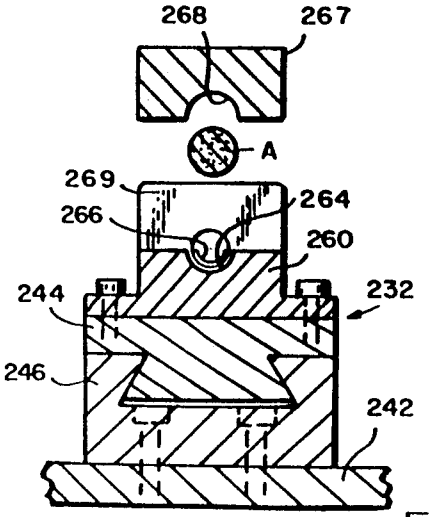
FIG. 4A is a transverse section taken on the line 4A—4A of FIG. 4, with the clamp elevated from the support for the jacket segment.

As seen in FIGS. 4 and 4A, the carriage 232 comprises a rigid elongate slide member 244 dovetailed to a platen 246, which is affixed to the platform 242, for longitudinal movement relative to the spindle 228. Reciprocal movement of the elongate slide member 244 is effected by a connecting rod 247 having a pin 248 at one end which is journalled to a post 250 secured to the slide member 244. The other end of the rod 247 is pivotally journalled on pin 252 which is eccentrically affixed to a disk 254. Disk 254 is affixed to shaft 256 at motor M2 which is mounted to a right-angularly disposed extension (not shown) of the platform 242. The eccentricity of the pin 252 provides for reciprocal linear movement of carriage 232 relative to spindle 228.

Figure 6A:
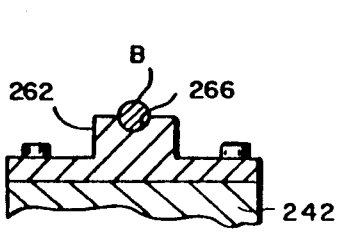
FIG. 6A is a transverse section taken on the line 6A—6A of FIG. 6 showing the support for the cartridge.

The slide member 244 of carriage 232 has first and second modular supports 260 and 262 for receiving and aligning jacket segment "A" and cartridge "B", respectively. The supports 260 and 262 have half-circular longitudinal recesses or flutes 264 and 266 FIGS. 4A and 6A), respectively, the axes of which are concentric with the axes of spindle 228 and abutment member 230. The recess 264 is of a cross section suitable for receiving the jacket segment "A", and the recess 266 is of a cross-section suitable for receiving the cartridge "B" in alignment with the jacket segment. Optionally, support 260 may be provided with end plates 269, each having a hole with a radius which is intermediate to the radii of recesses 264 and 266, the centers being aligned. The end plates 269 aid in restraining longitudinal movement of jacket segment "A" as it is impaled on spindle 228 and subsequently on cartridge "B".

Disposed above the support 260 is a clamp 267 containing a half-circular longitudinal recess 268 with a radius corresponding to that of the recess 264. The clamp 267 is movable from a position elevated rom support 260 to a position of engagement therewith, to enable placing the jacket segment in the recess 264 and holding it therein, (as shown in FIG. 4B), and the subsequent removal of the assembled aerosol generating module "M".

The abutment member 230 is in the form of a rod 274 which has one end attached to a support block 270. The face end **274*a* of rod 274 is adjacent the support 262. The support block 270 is slidably mounted on the slide member 244 and is capable of movement in unison with the slide member as well as relative to the slide member. Block 270 is slidable between a pair of spaced, parallel gibs 272 secured to the slide member 244 (FIG. 5). A stop member 276, secured to the slide member 244, engages the block 270 to transmit the movement of the slide member 244 toward the spindle to block 270, and thus to the rod 274**.

A latch 278 is pivotally supported on arm 280, which is carried on a bracket 282 disposed transversely of the carriage 232 and affixed to platform 242. The latch 278 is biased (e.g. by gravity or by spring means) toward the block 270 and is provided with a downwardly-facing inclined cam surface 284 that engages with an upwardly-facing inclined surface 286 on the block 270. Movement of the slide member 244 to the left as viewed in FIGS. 4 through 6 (i.e., toward the spindle 228) will move the block 270 to the left relative to the latch 278 such that the inclined surfaces will raise the latch, allowing the block to move forwardly beneath the latch. Movement of the block 270 to the left will ultimately cause the vertical face 288 of the latch (see FIG. 6) to engage the right hand vertical surface 287 of the block 270, thus restraining movement of the block 270 and, hence, the rod 274 toward the right with respect to the slide member 244 (i.e., away from the spindle). Thus, as the supports 260, 262, which are attached to the slide member 244, move away from the spindle 228, rod 274 is constrained from movement in relation to them. Upon movement of the slide member away from the spindle, a cartridge "B" disposed in recess 266 of support 262 will be engaged by abutment rod 274 and be inserted into the jacket segment contained in recess 264 of support 260.

Disengagement of the block 270 from the latch 278 is effected by lifting the latch from engagement with the block 270. The block 270 can then be moved to the right to a position of re-engagement with the stop member 276. Alternatively, block 270 can be modified, for example, as illustrated in FIG. 7B, to permit automatic release of the latch after the cartridge is inserted into the jacket segment. This can be accomplished, for example, by providing a second upwardly-facing inclined cam surface 285 on the right end of block 270 and attaching a flat piece of spring steel 290 to face 287 so that the spring steel 290 engages latch face 288 to inhibit the latch from riding up the second inclined cam surface 285 and releasing block 270. The spring steel 290 has a suitable thickness to restrain movement of block 270 while the cartridge is being inserted into the jacket segment but to bend thereafter to permit latch 268 to ride up the second inclined cam surface 285, thereby releasing block 270 to move with slide member 244. Suitable means (not shown) can be used to return block 270 into engagement with stop member 276, e.g. spring biasing means.

Full automation of the apparatus can also be accomplished by the use of a cam to release the latch at the point when the cartridge is suitably inserted in the jacket segment. As aforesaid, spring means can be used to subsequently reengage block 270 with stop member 276 to start the next cycle.

Figure 6:
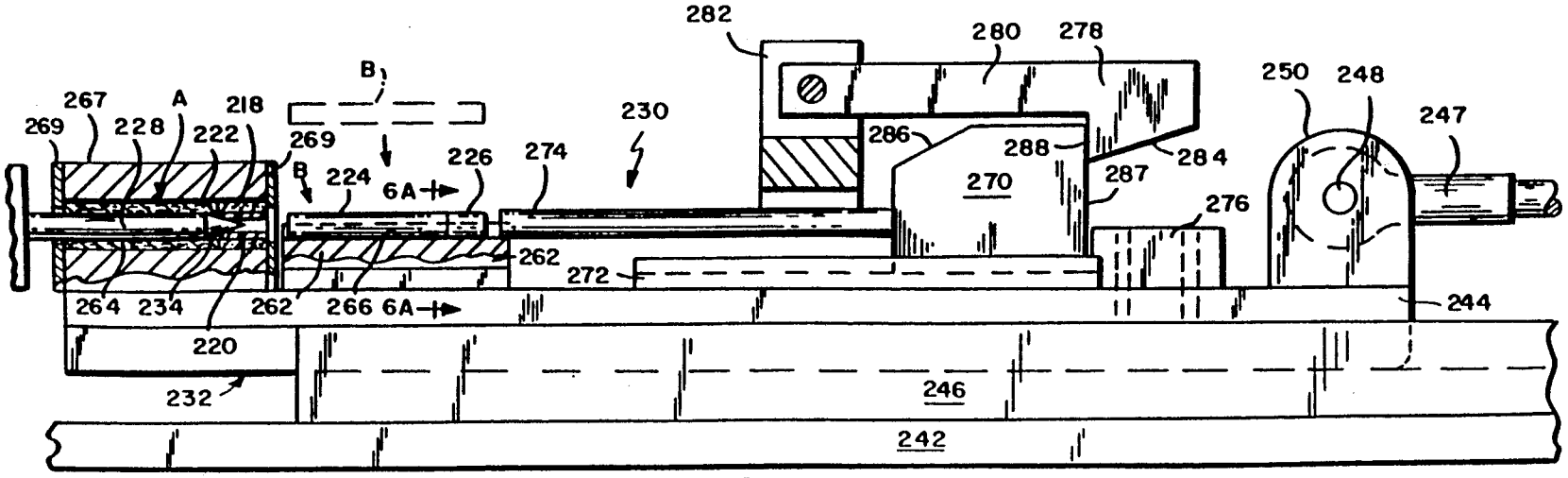
FIG. 6 is a side elevation of FIG. 5 partly in section showing the jacket segment impaled on the spindle and the cartridge deposited on the carriage in the advanced position of the carriage.

In operation, the jacket segment "A" is deposited in the recess 264, whereupon the clamp 267 is moved into engagement with the support 260 to restrain movement of the jacket segment in the recess. As illustrated, the jacket segment "A" is disposed in the recess 264 with the sleeve 3 of insulating material at the end remote from the spindle 228. The cartridge "B" is deposited in recess 266 of support 262, with the fuel element adjacent rod 274 of abutment member 230. The slide member 244 is now moved toward the spindle by actuation of motor M2 to impale the jacket segment "A" on the rotating spindle 228 to form longitudinal opening 1 in rod 2. The conical end 234 of the spindle 228 serves to pierce the rod longitudinally to the point of contact with the tubular member 220. During this movement, abutment rod 274 is moved with slide member 244 in unison with jacket segment "A" and cartridge "B", and latch 278 rides up cam surface 286 and over block 270 to a position to engage the block and restrain reverse movement of the block (FIG. 6). At this position, as shown in FIGS. 5 and 6, the cartridge "B" is on support 262 in alignment with the jacket segment "A" and between that segment and the abutment rod 274, with the capsule 5 at the end adjacent the pierced jacket segment and the fuel element 7 at the end adjacent the abutment member 230.

The slide member 244 is now retracted, that is, moved away from the spindle. The initial movement of the slide member causes abutment rod 274 to engage the fuel element 7, thus restraining movement of the cartridge "B" with the slide member, i.e. further movement of cartridge "B" is prevented because latch 278 is engaged with block 270 of abutment member 230. Further movement of the slide member 244 toward the right causes cartridge "B" to be inserted into the opening in the jacket while the spindle is simultaneously being withdrawn from the opening.

Figure 7:
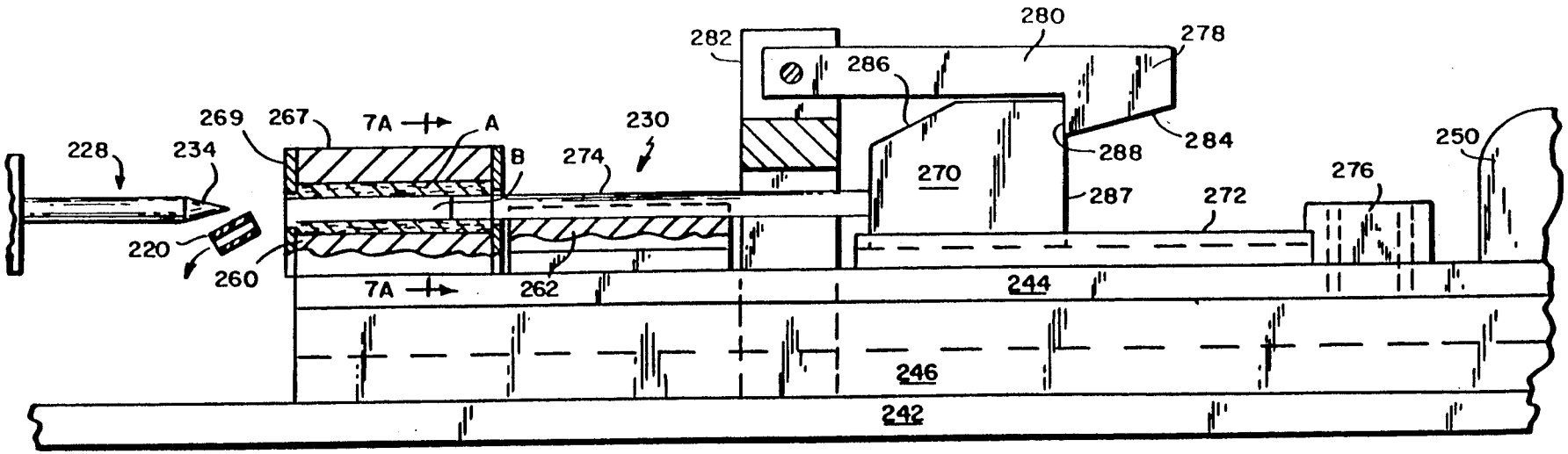
FIG. 7, is a vertical elevation, partly in section, showing the jacket segment impaled on the cartridge in the retracted position of the carriage.
Figure 7B:
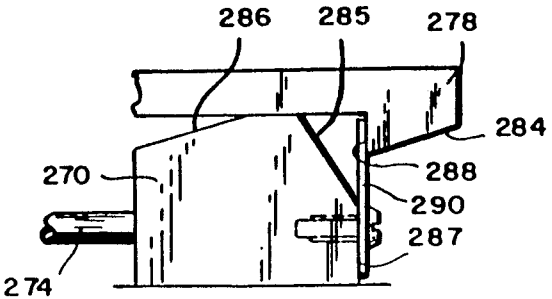
FIG. 7B is a partial vertical elevation showing an alternative configuration for the support block of the abutment member for the embodiment illustrated in FIG. 7.

As this occurs, the tubular member 220 is pushed through the longitudinal opening 1 in rod 2, and eventually falls out at the spindle end, as shown in FIG. 7. During this movement, the tubular member is advantageously held between the conical tip 234 of spindle 228 and cartridge "B", which tends to prevent any change in orientation of tubular member 220 which could dislodge fibrous material from rod 2.

Following this telescopic movement of the jacket segment over the cartridge, the clamp 267 is lifted and the assembled components removed from the support 260. The latch 278 is now disengaged from the block 270 and the rod 274 retracted to engage block 270 with stop member 276, whereupon the apparatus is ready to again receive a jacket segment "A" and cartridge "B" for assembly.

The clamp 267, latch 278 and abutment member 230 for this embodiment of the invention are shown as manually actuated. However, it is within the scope of the invention to provide linkage operable in timed relation to the reciprocal movement of the slide for effecting completely automatic movement of the aforesaid components as is well known to those skilled in the art.

Preferably, the apparatus of the present invention is fully automated for a production line using suitable known means for supplying the jacket segments and cartridges to the apparatus and suitable means for removing the completed aerosol generating modules from the apparatus.

More preferably, an apparatus in accord with the present invention, for high speed production of smoking articles, comprises a multiple number of automated stations having the capabilities of the apparatus described above. Conveniently, such stations can be located on a linear or looped assembly line or on a rotatable member such as a rotary table or a rotatable drum.

Figure 8:
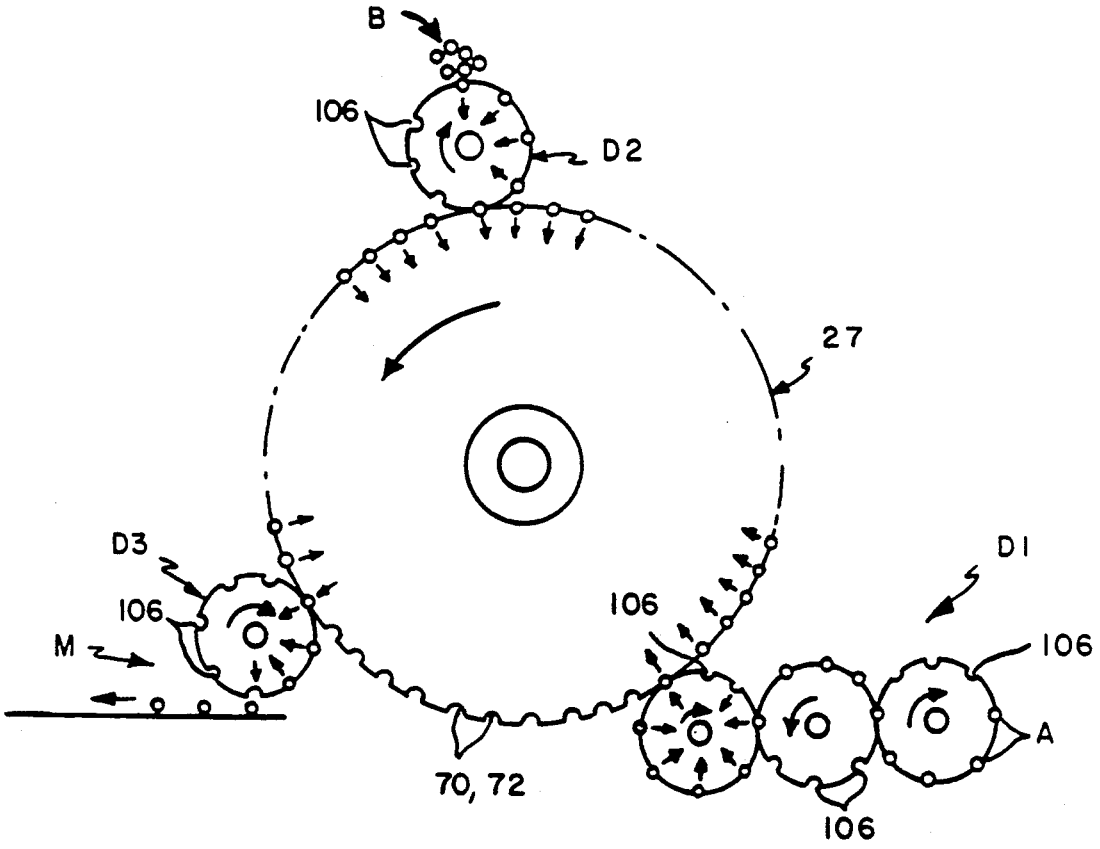
FIG. 8 diagrammatically shows one preferred embodiment of an apparatus in accord with the present invention, comprising a rotating drum, with rotary transfer drums D1 and D2 for depositing smoking article components (e.g., jacket segments "A" and aerosol generating cartridges "B") thereon, and rotary transfer drum D3 for removing the composite structure "M" therefrom.
Figures 9, 17:
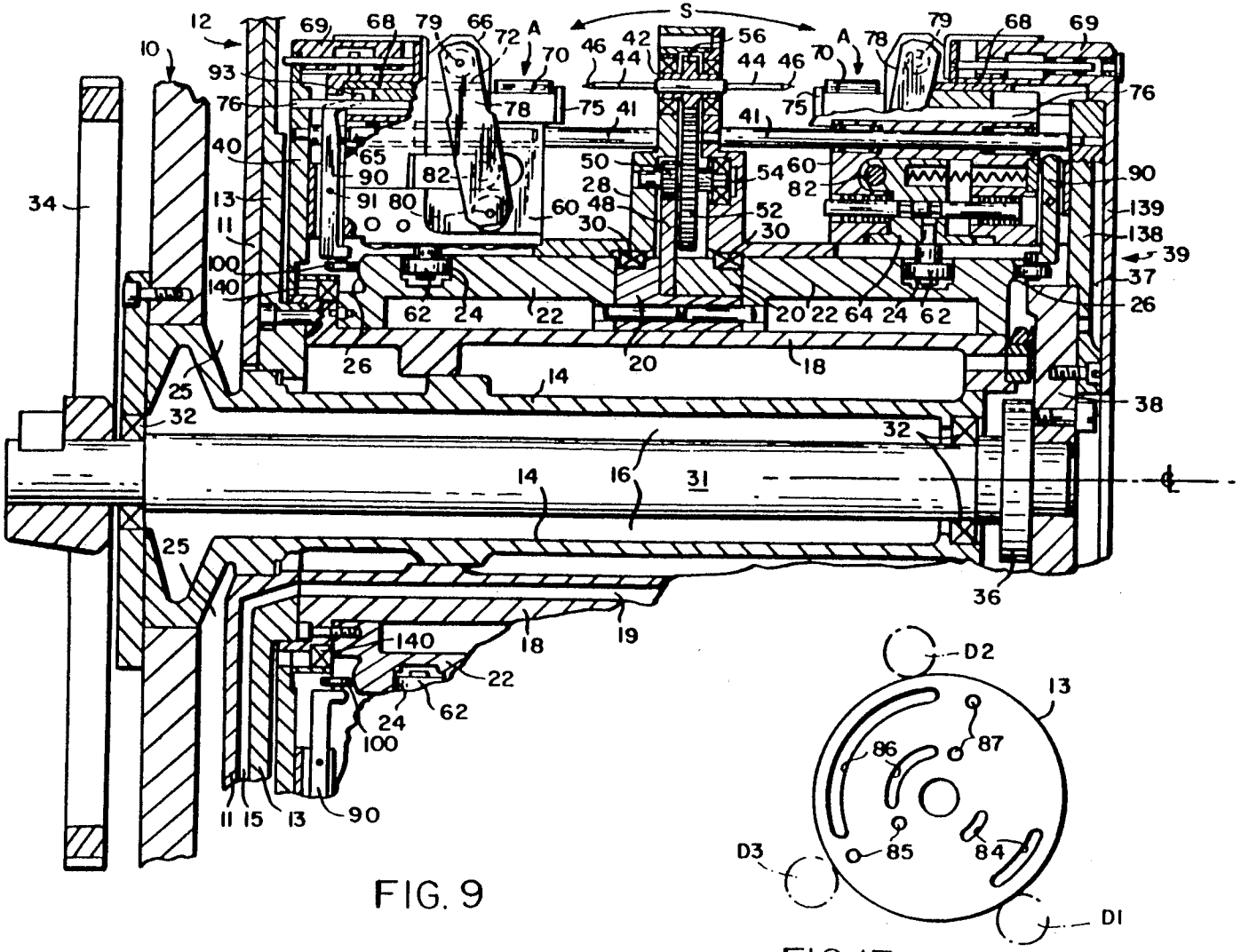
FIG. 9 is a fragmentary longitudinal view of an adjacent or tandem pair of stations in a preferred rotating drum apparatus in accord with the present invention, having various sectional views rotated about the axis to more clearly illustrate various features of the apparatus, and showing jacket segments A positioned thereon.
FIG. 17 diagrammatically shows, in relation to the transfer drums, the openings in mounting plate 12 that provide vacuum or low pressure air to the stations.

A preferred high speed production apparatus in accord with the present invention is illustrated in FIGS. 8 to 19. This preferred apparatus in accord with the invention generally comprises a rotating assembly drum, generally indicated by reference numeral 27 of FIG. 8. Referring specifically to FIG. 9, the apparatus has a plurality of stations "S" typically designed in essentially axially aligned mirror image pairs forming parallel tracks of stations, each station comprising a carriage 60 and a clamp 66, and a plurality of spindles 44, recesses 70, 72, abutment members 68, etc. so that two sets of aerosol generating modules may be assembled in parallel. As shown in the illustrated embodiment, each station is designed to assemble three aerosol generating modules simultaneously. (See FIG. 14 and FIG. 16-A-16-0)

As shown in FIG. 8, preferably there are transfer drums D1, D2 and D3 disposed about the assembly drum 27 for rotation in timed relation to drum 27 for depositing the components "A" and "B" in the recesses 70 and 72 on each station in timed relation with the movement of the carriage 60 and clamp 66, and for removing the aerosol generating modules M from the drum after assembly. Transfer drum D1 is preferably located on the upgoing side of drum 27 for depositing jacket segments "A" in recesses 70. Transfer drum D2 is located near the top of drum 27 for depositing cartridges "B" in recesses 72. Transfer drum D3 is preferably located on the downgoing side of the drum 27 for removing the combined aerosol generating modules "M". The transfer drums are provided with recesses 106 for receiving the components and vacuum means depicted by the arrows for holding them in place on the transfer drums before or after transfer.

Typically, the jacket segments are fed directly from a suitably modified conventional type segment combining machine (not shown), such as a Hauni MULFI, by a series of vacuum assisted transfer drums D1. Such drums are used to position two or more jacket segments laterally to line up with the parallel tracks of stations on drum 27. The jacket segments can also be fed from trays or hoppers using suitably arranged vacuum assisted rotary devices or equivalent means.

Typically, the cartridges are fed from trays or hoppers positioned above assembly drum 27 using transfer drum D2, or other suitably arranged vacuum assisted rotary devices or equivalent means.

The completed aerosol generating modules "M" may be deposited on a belt as in FIG. 8 and transported for packaging. Alternatively, the modules can be transferred to a tipping machine by a series of rotary transfer drums or other equivalent means (not shown), where they are combined with mouthend pieces to form cigarette-type smoking articles.

Again referring to FIG. 9, the drum apparatus comprises a supporting structure 10 to which is mounted a horizontally-disposed, tubular support 14 defining interiorly thereof an axial opening 16. A vertical mounting plate 12 is mounted on support 14 and attached to supporting structure 10 near the periphery of the drum (not shown). Mounting plate 12 consists of flat plate 11 and stepped plate 13. Flat plate 11 has grooves 15 radially formed in its inner surface, which in combination with stepped plate 13, provide passageways for low pressure air. Between supporting structure 10 and mounting plate 12 is a vacuum chamber 25. Passageways through mounting plate 12 at suitable locations provide vacuum to the stations "S". See 84, 86 in FIG. 17. A cylindrical sleeve 18 is mounted to the tubular support 14 in concentric relation thereto and attached to the stepped plate 13 of the mounting plate 12. Sleeve 18 has conduits 19 for communication of vacuum or low pressure air to the outside end of the drum. Passageways through plate 13 at suitable locations 85, 87) provide communication between chamber 25 and conduits 19. (FIG. 17)

Figure 12:
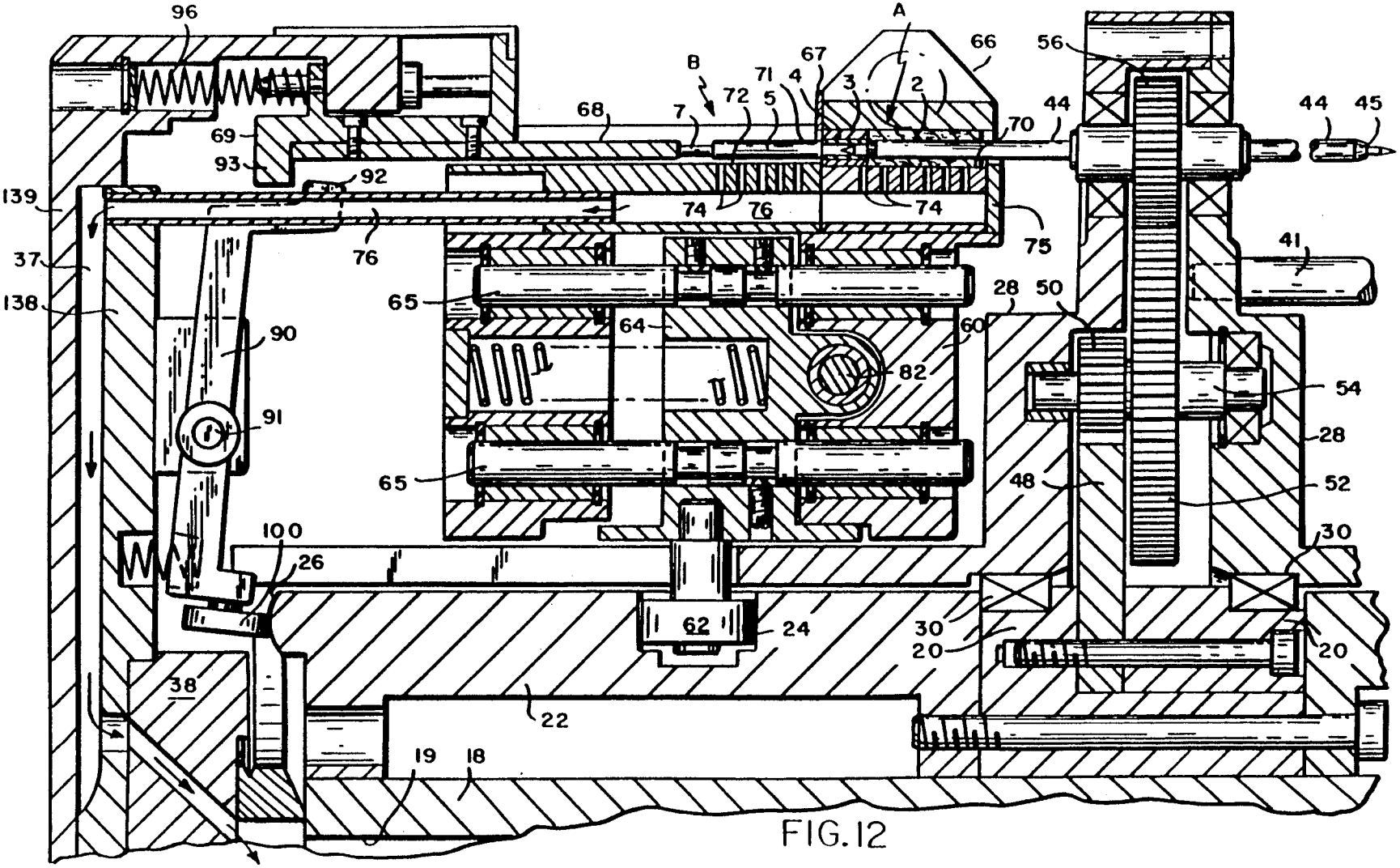
FIG. 12 is an enlarged fragmentary section showing the station of FIG. 10 with the jacket segment impaled on the spindle, and with the abutment member engaged with the cartridge, just prior to insertion of the cartridge into the jacket segment.
Figure 13:
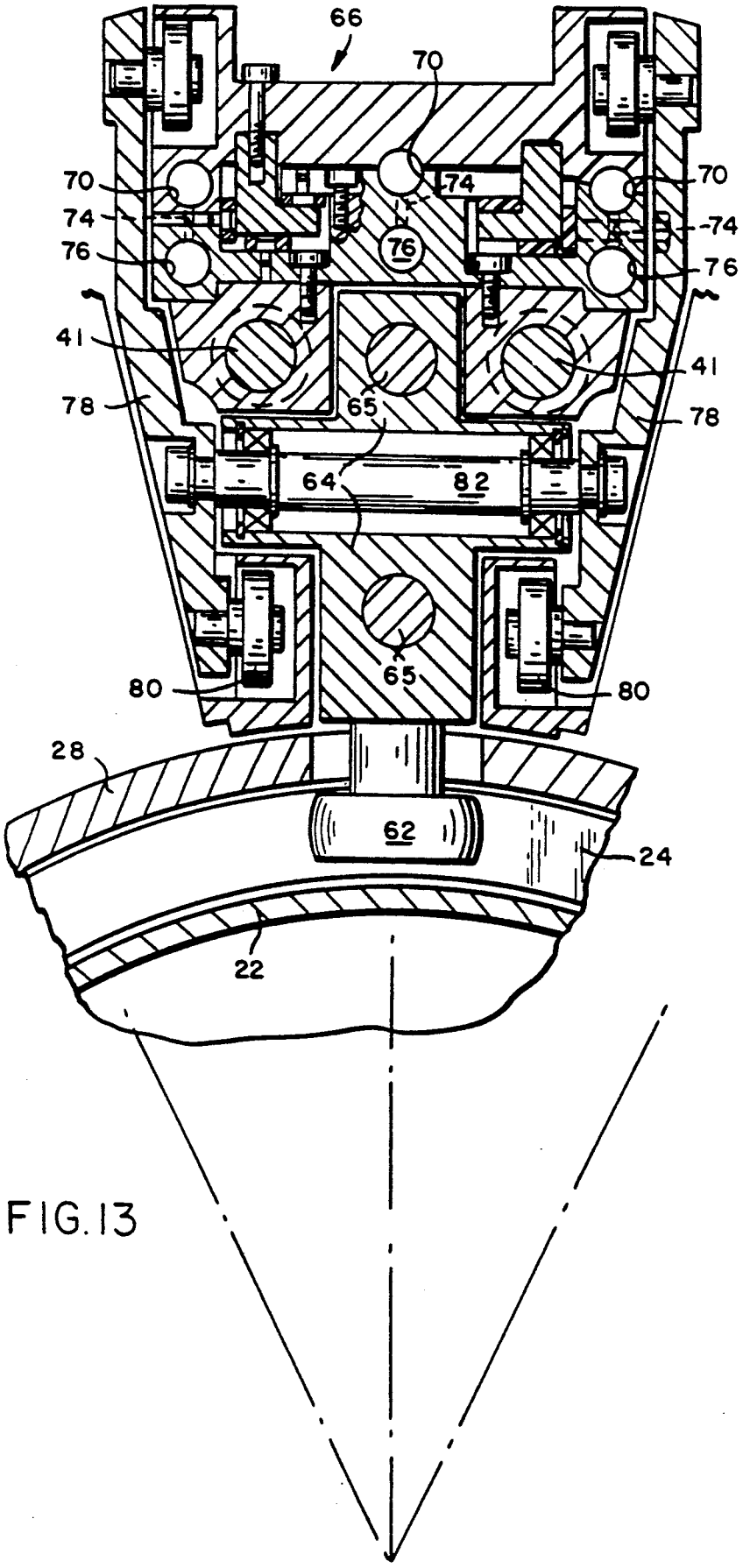
FIG. 13 is a fragmentary section taken along the line 13—13 of FIG. 10.
Figure 14:
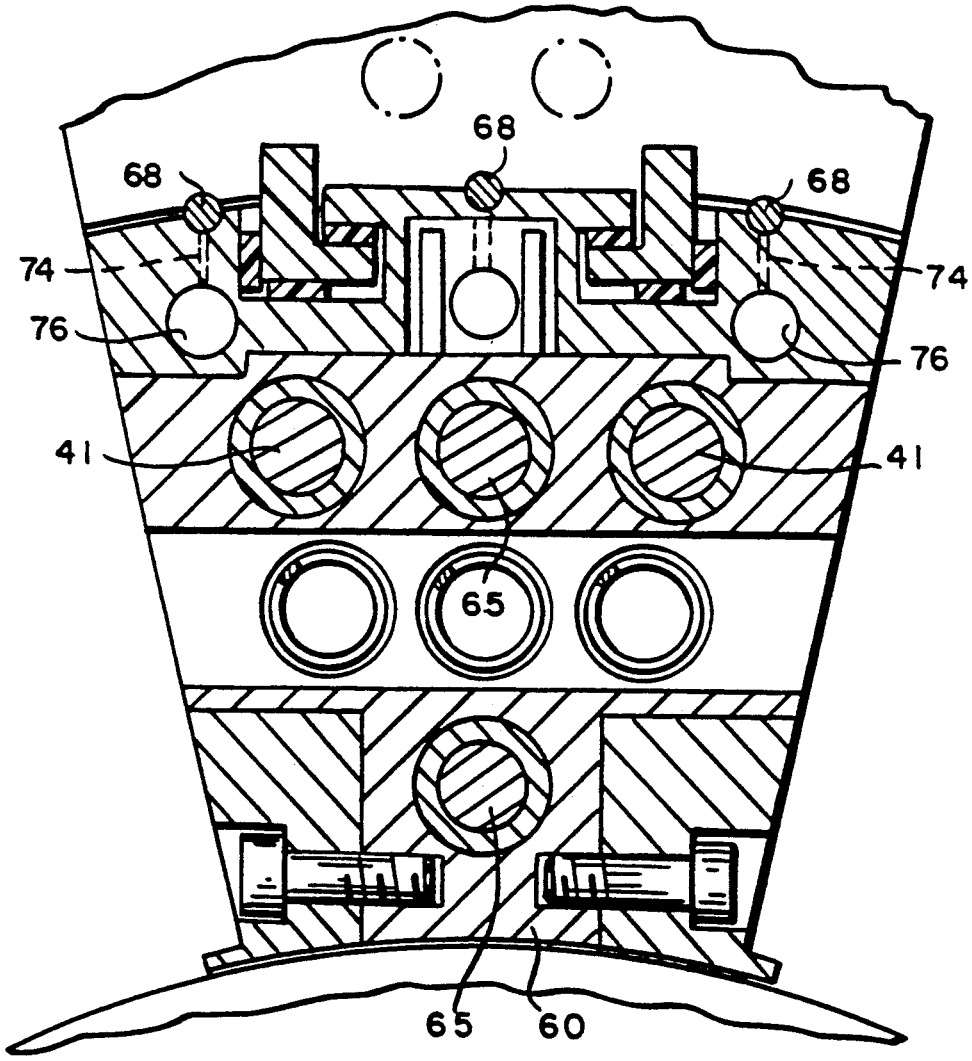
FIG. 14 is a fragmentary section taken along the line 14—14 of FIG. 10.
Figure 15A:
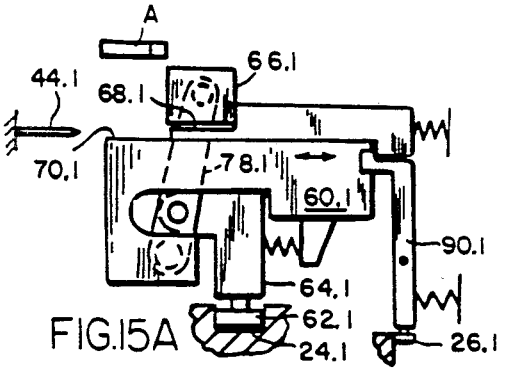
FIGS. 15-A to 15-H are partial elevational views that schematically illustrate the successive operations of one station of the apparatus of FIG. 9 entailed in combining the jacket segment and cartridge.
Figure 15E:
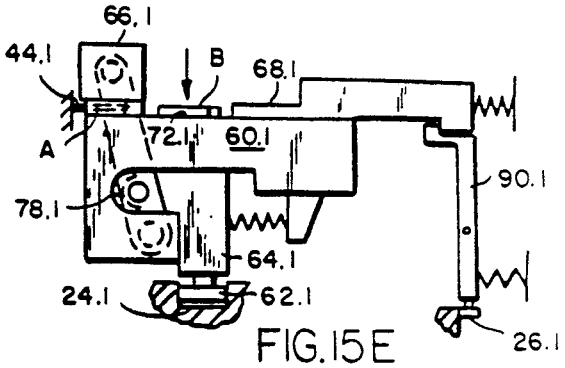
Figure 15B:
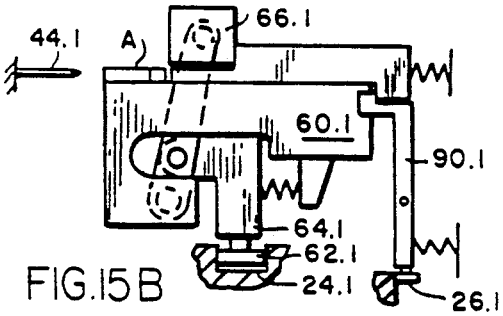
Figure 15F:
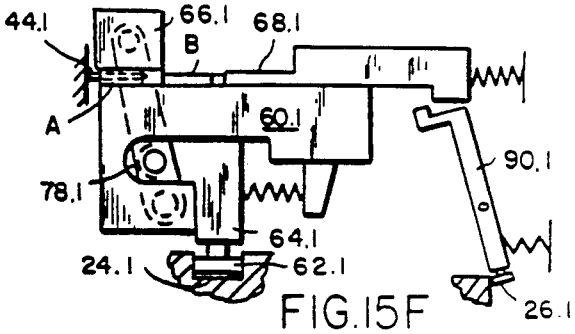
Figure 15C:
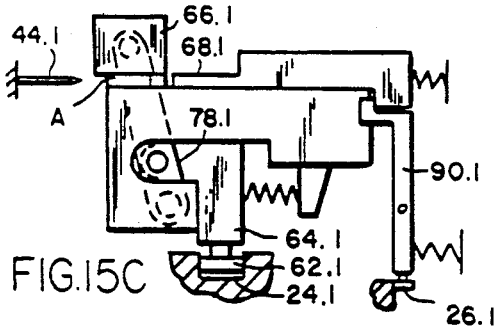
Figure 15G:
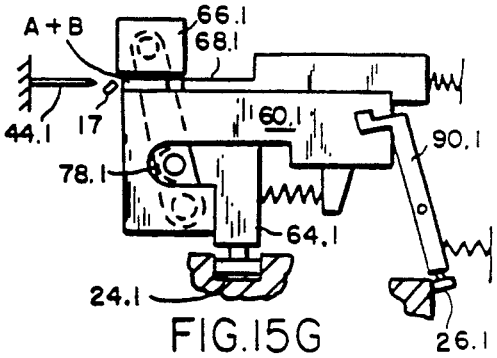
Figure 15D:
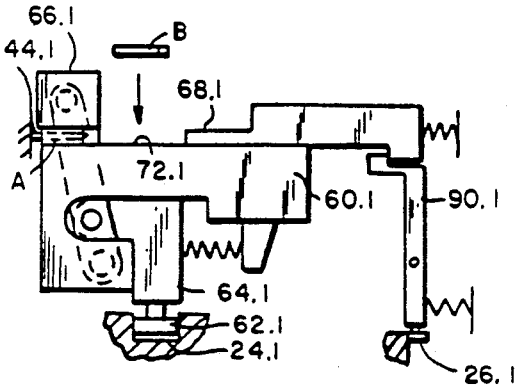
Figure 15H:
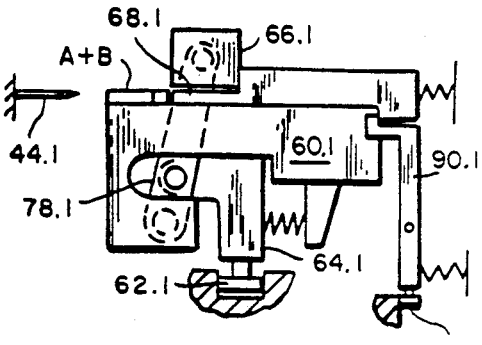
Figure 16A:
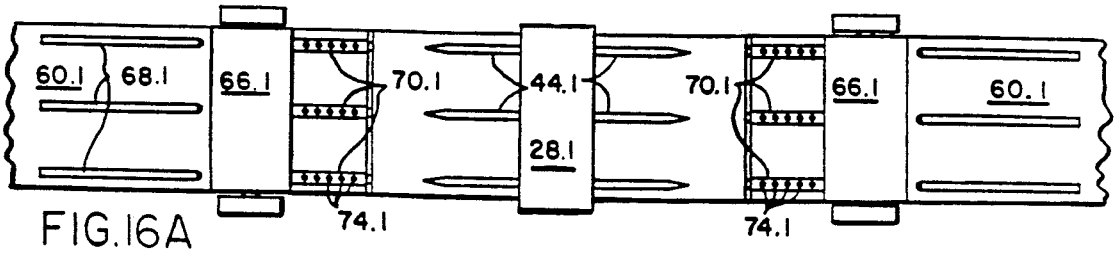
FIGS. 16-A to 16-O are partial plan views schematically illustrating the successive operations of one station of the apparatus of FIG. 9 entailed in combining the jacket, segment and the cartridge.
Figure 16B:
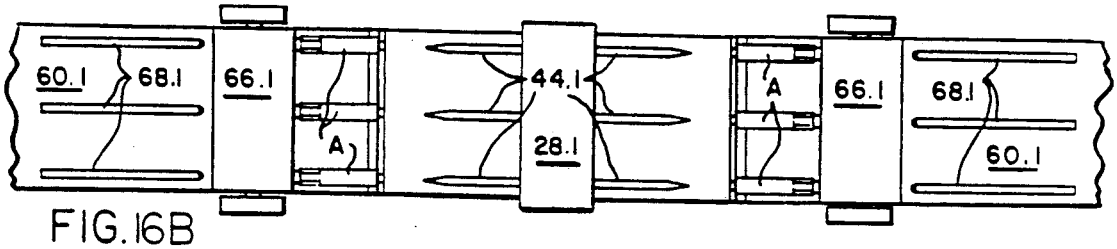
Figure 16C:
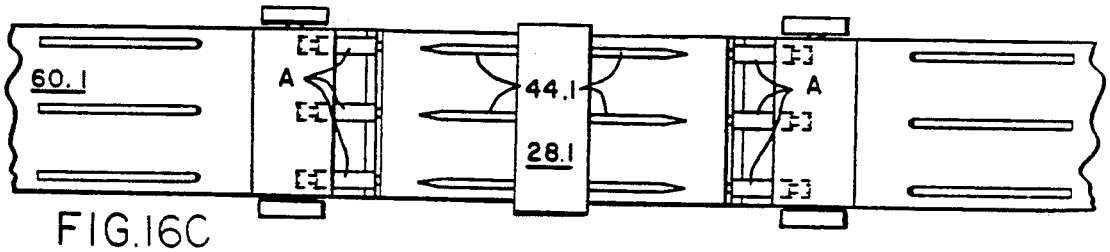
Figure 16D:
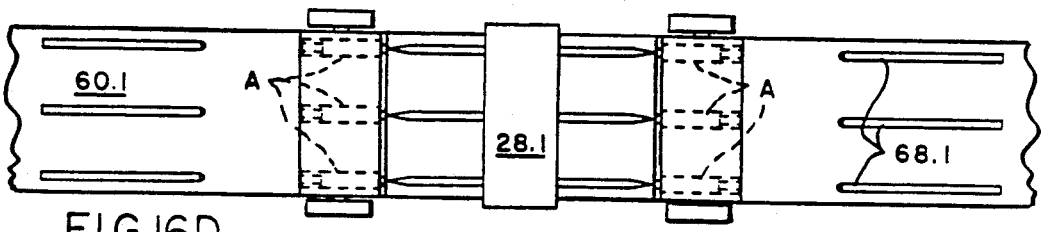
Figure 16E:
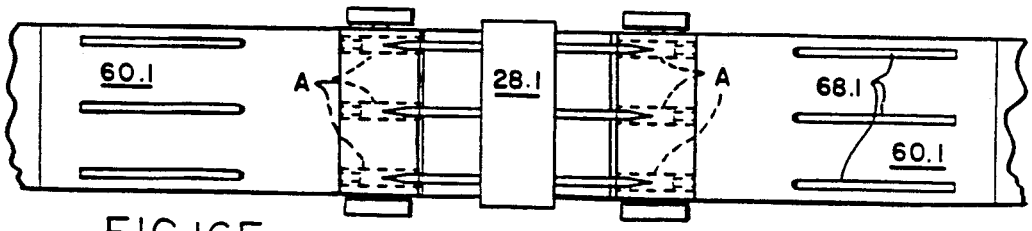
Figure 16F:
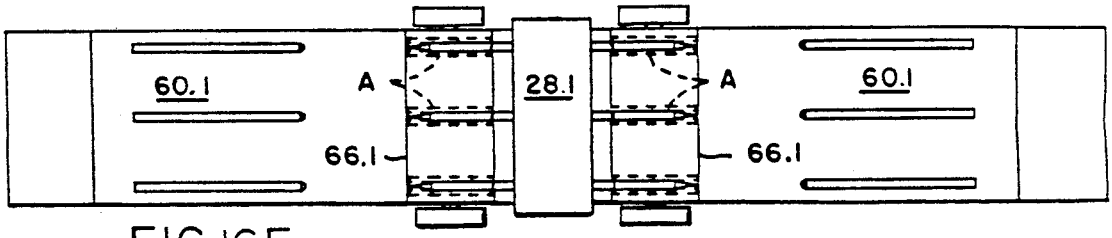
Figure 16G:
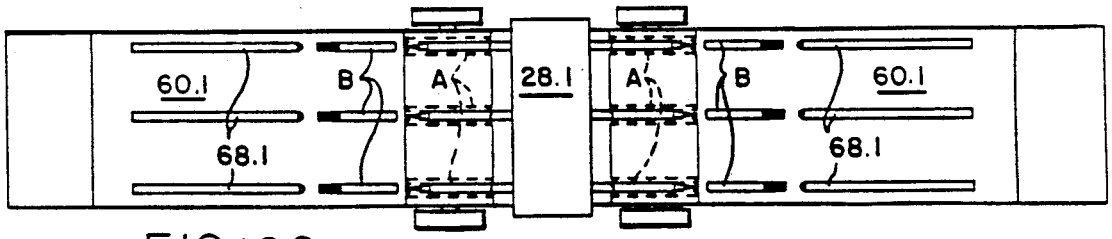
Figure 16H:
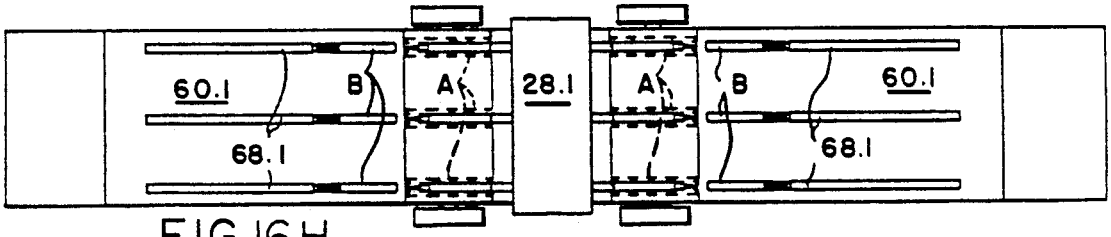
Figure 16I:
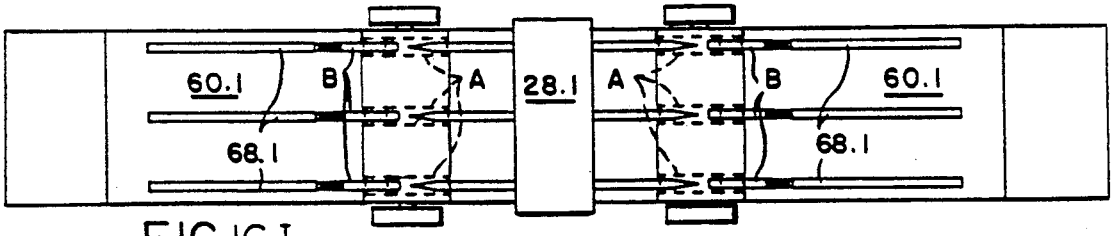
Figure 16J:
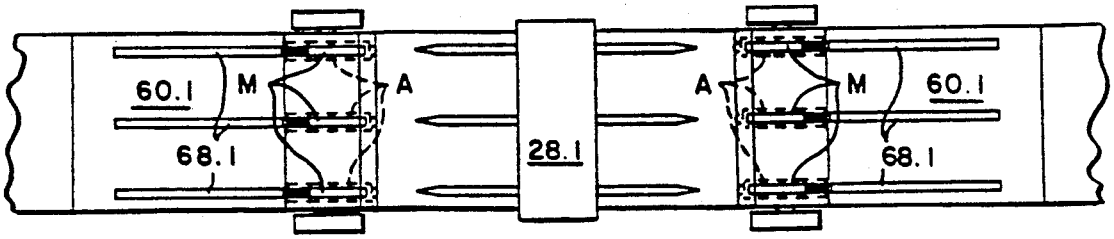
Figure 16K:
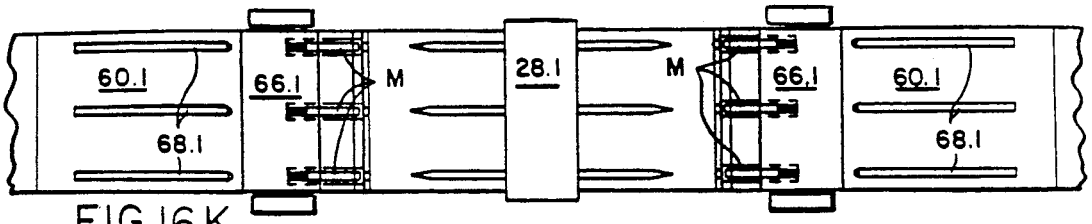
Figure 16L:
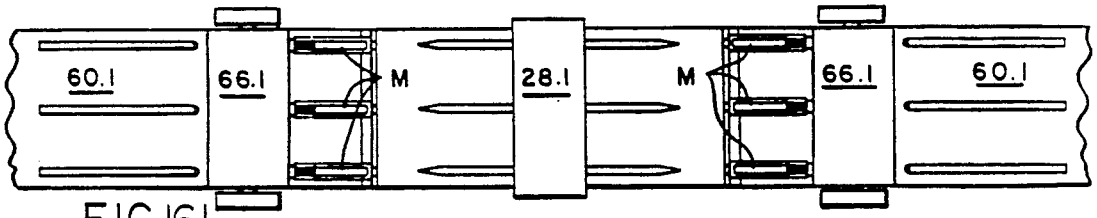
Figure 16M:
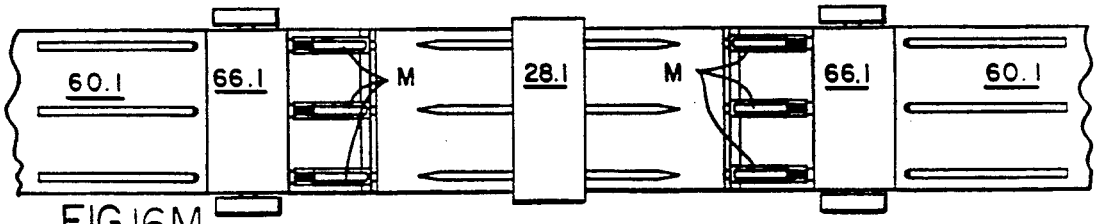
Figure 16N:
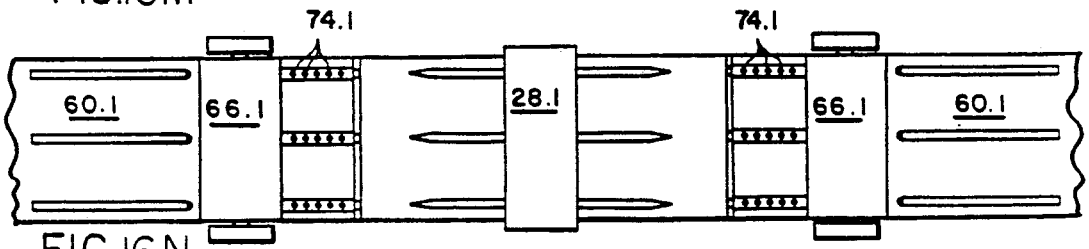
Figure 16O:
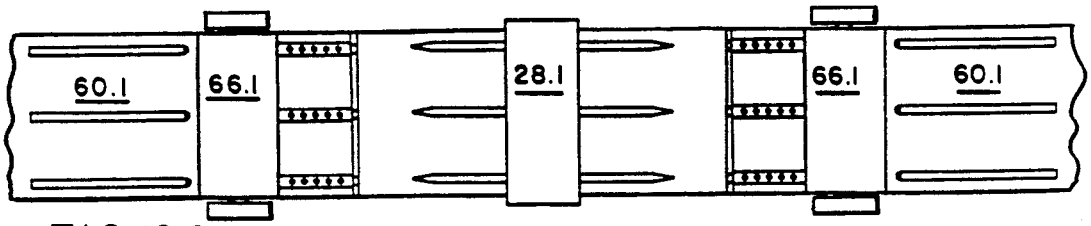

A hub 20 is non-rotatably mounted to the sleeve 18 midway between its opposite ends, and cam sleeves 22 are bolted to opposite sides of the hub. The cam sleeves 22 have on their cylindrical surfaces cam grooves 24 and at their ends profile cam surfaces 26. The hub 20 is conveniently made in two pieces to hold the annular ring gear 48 which is bolted thereto. (FIG. 12)

An annular support 28 is mounted to the hub 20 on axially-spaced annular bearing rings 30 for rotation about a horizontal axis. Rotation of the support 28 about the hub 20 is effected by a drive shaft 31 rotatably supported in bearings 32 within the tubular support 14. The shaft 31 has fixed to one end a drive gear 34 by means of which it can be rotated. At the other end of the shaft 31, there is fixed a radial flange 36. The radial flange 36 has bolted thereto a disk 38 and this, in turn, has bolted to it an outer end plate 39. The end plate 39 is conveniently formed in two sections. Plate 138 is attached to disk 38 and contains grooves 37 for forming passageways for vacuum and/or low pressure air to each outer station. Plate 139 is attached to plate 138 and completes the passageways. The passageways connect with conduit 19 in sleeve 18 for communication with mounting plate 12 and the source of vacuum or low pressure air.

An inner end plate 40 is rotatably mounted on sleeve 18 on ring bearing 140, adjacent to the stationary mounting plate 12. Vacuum and low pressure air are supplied to each of the inner stations directly through passageways 84, 85, 86, 87 in plate 13. See FIG. 17. Conduits 76 at each inner station extend through inner end plate 40 to a point in close proximity, preferably about 0.1 mm, to plate 13. This provides communication between the passageways in plate 13 and conduits 76 for the transmission of vacuum or low pressure air to the stations "S".

At each station, two shafts 41 are connected at one end to an end plate 39 (or 40) and at the other end to the support 28. These shafts 41 aid in providing structural support to the rotating components of the drum as rotation of the central shaft 31 effects rotation of the support 28.

Between each longitudinal or tandem pair of stations, the annular support 28 has peripherally thereof three rotatable bearing sleeves 42, in which there are mounted oppositely-facing rotatable spindles 44 having conical ends 46. Preferably, the conical end 46 of each spindle 44 has a shoulder 45 (as shown in FIG. 10) which is dimensioned to abut the edge of tube 4 in the jacket segment.

As best shown in FIG. 9 an annular ring gear 48 is mounted to the fixed hub 20, and between the station pairs, three annularly spaced spur gears 50 are mounted to the rotatable support 28 in mesh with the annular gear 48. The spur gears 50 are each fixed to a drive gear 52 which, in turn, is fixed to a shaft 54 journalled on the support 28 so that rotation of the support 28 about the hub 20 and ring gear 48 rotates each of the three drive gears 52. Each drive gear 52 meshes with one spindle gear 56 in a train of fourteen spindle gears 56, and thereby drives all fourteen spindle gears simultaneously. Each spindle gear 56 is mounted on a bearing sleeve 42 and thereby rotates a set of opposite-facing spindles 44. The spindle gears 56 at the end of each train of fourteen gears do not mesh with the end gear in the adjacent train of gears. To accomplish this, the gear teeth on these end gears are less than half the width of the gear and the partial width teeth on one end gear are on one side of the gear while the partial width teeth on the adjacent end gear are on the other side so that they do not mesh. Thus, rotation of the support 28 relative to the fixed hub 20, by way of the aforesaid gears, effects rotation of three trains of fourteen sets of spindles 44 about their horizontal axes which, as illustrated, are parallel to the axis of rotation of the drum.

At each station, a transport comprising a carriage 60 and a clamp 66 is slidably mounted on two horizontally-disposed shafts 41. The carriages 60 are movable axially along the shafts 41 relative to the spindles 44. To effect reciprocal movement, the carriages 60 are each provided with an internal coupling member 64, which is slidably mounted in carriage 60 on spindles 65 and spring biased toward rotating spindles 44. Each coupling member 64 has a cam follower 62 journalled in the cam groove 24 in cam sleeve 22. The cam grooves 24 are contoured so as to effect axial reciprocal movement of the coupling members 64 and, thus, carriages 60 when the assembly drum is rotated.

Figure 10:
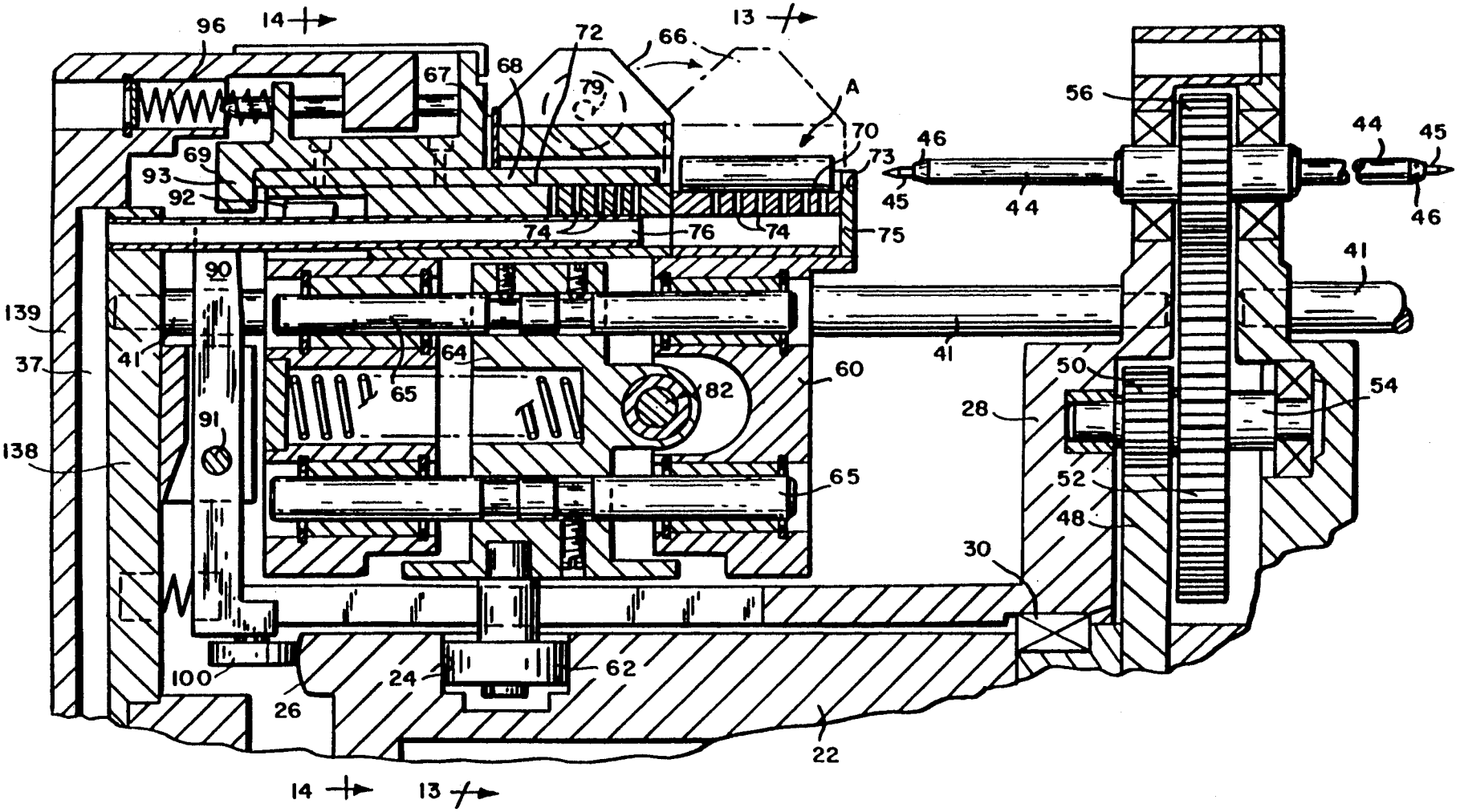
FIG. 10 is an enlarged fragmentary section showing one station of the apparatus of FIG. 9 in its initial position and having a jacket segment "A" positioned thereon.
Figure 11:
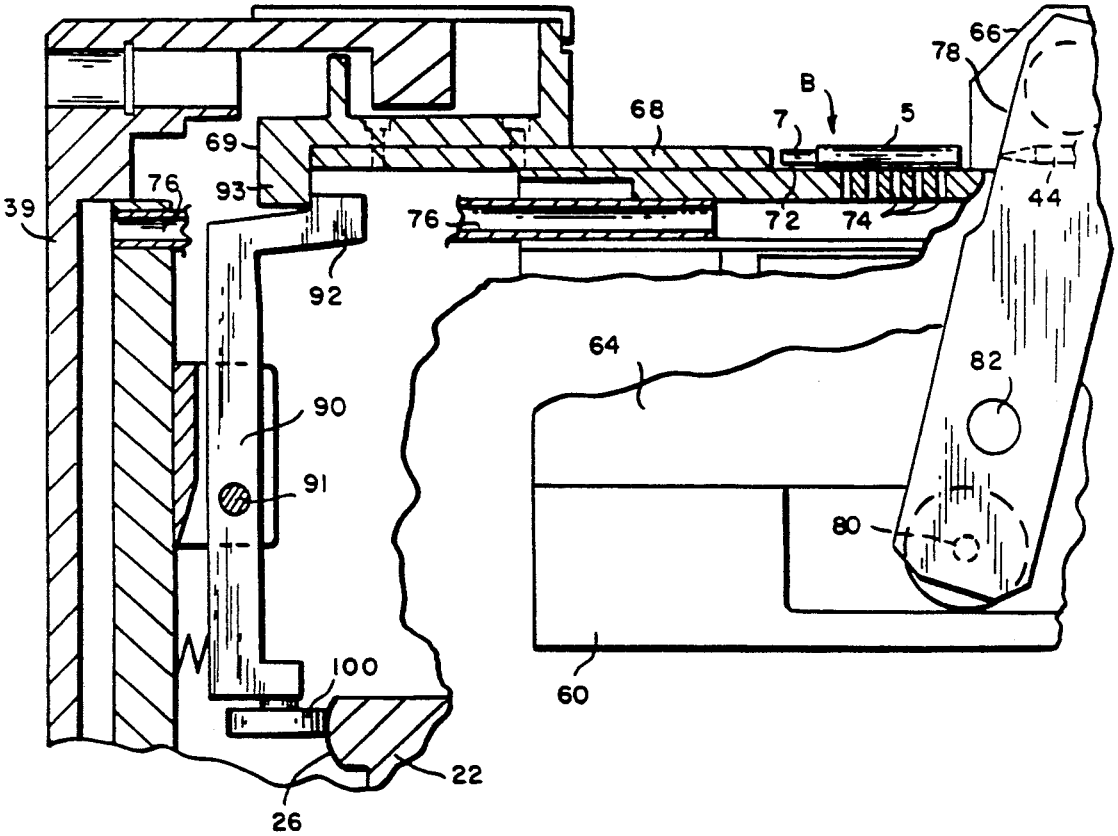
FIG. 11 is an enlarged fragmentary section showing the station of FIG. 10 in the position having the jacket segment impaled on the spindle and having a cartridge deposited thereon.

The clamps 66 are mounted to carriages 60 on support arms 78 which are pivotally coupled to the clamp at 79, to the carriages at 80,and to the coupling members 64 at shaft 82, FIGS. 10 and 11, for movement relative to the carriages 60 parallel to the axis of the spindles 44. Thus clamp movement also is effected by the contour of cam groves 24. Each clamp 66 has a retaining member 67, preferably vertically movable, located distally from the spindles to restrain lateral movement of the jacket segment as it is impaled on a spindle. The retaining member 67 can be mounted to clamp 66 on a leaf spring to permit movement in the upward direction when the cartridge moves under the retaining member, thereby avoiding jamming and breakage if there exists slight misalignment.

Figure 18:
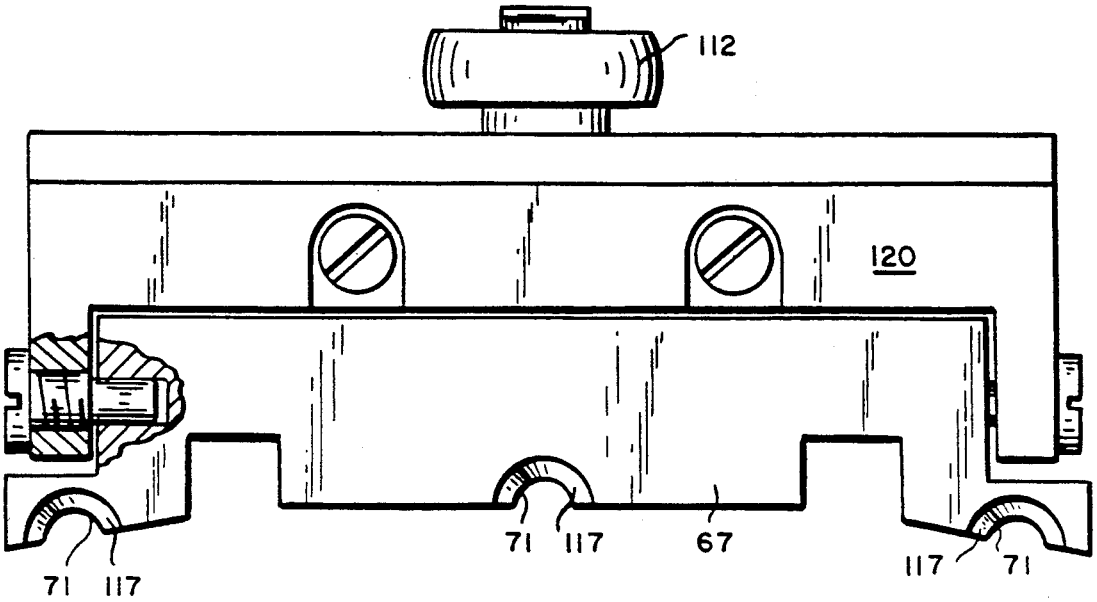
FIG. 18 is an elevation of a preferred structure for lifting retaining member 67 on clamp 66 for the step of inserting the cartridge "B" into jacket segment "A".
Figure 19:
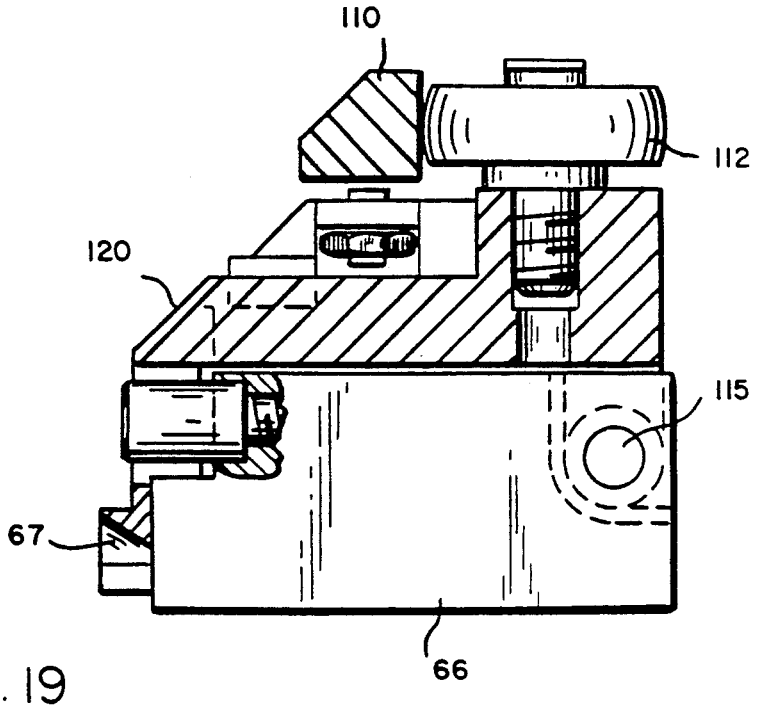
FIG. 19 is a side view, partly in section, of the structure of FIG. 18 illustrating the cam follower in contact with a cam surface to lift the retaining member.

FIGS. 18 and 19 illustrate a preferred structure for lifting retaining member 67 for the step of inserting cartridge "B" into jacket segment "A". The structure has a support bridge 120 to which is mounted retaining member 67 and a cam follower 112. The support bridge 120 is pivotally mounted at 115 to clamp 66. Preferably, the retaining member 67 has tapered surfaces 117 from its outward face to the openings 71 that align with the recesses 70, 72 on carriage 60. When the cam follower 112 contacts cam surface 110 (which is stationary, mounted (not shown) e.g. to the frame for drum 27) for the insertion step, cam surface 110 moves cam follower 112 (to the right in FIG. 19) to cause support bridge 120 to pivot at 115 thereby lifting retaining member 67 to permit cartridge "B" to pass through opening 71 without hitting the retaining member.

Each carriage 60 includes a first support area, defined by three outwardly-facing recesses 70 (FIGS. 10 11 and 14), the axes of which coincide with the axes of the spindles 44. Recesses 70 are dimensioned to receive and support jacket segments "A" (FIG. 1), each preferably comprising a jacketed rod 2 of tobacco, at one end of which is the sleeve 3 of insulating fibers surrounding a plastic tube 4. See FIG. 12. Each clamp 66 also has complementary recesses of the same dimensions as recesses 70 which are aligned with and cooperate with recesses 70 to restrain movement of the jacket segment. The retaining member 67 on clamp 66 has openings 71 aligned with the recesses. Openings 71 are dimensioned to restrain lateral movement of the jacket segment but to permit the aerosol generating cartridges to pass through to be inserted into the jacket segments.

At the spindle end of recesses 70 is a retaining plate 75 to restrain lateral movement of the jacket segment when it is impaled onto the cartridge. Retaining plate 75 has openings 73 aligned with recesses 70 and dimensioned to permit the spindle 44 to pass through to make a passage in jacket segment and to permit tube 4 to pass through to be ejected from the jacket segment while restraining movement of the jacket segment toward the spindle.

Each carriage 60 also includes a second support area defined by three outwardly-facing recesses 72 which are concentric and in alignment with recesses 70, and which are dimensioned to receive and support the aerosol generating cartridges "B" (FIG. 2) each preferably comprising capsule 5, at one end of which is the heat-generating element 7, in alignment with the axes of the jacket segments. See FIG. 12.

Each cylindrical recess 70 contains a plurality of orifices 74 which are in communication with a passage 76 extending lengthwise of the carriage, and mounted in end plate 39, 40 in flow communication with the passageways therein. Each recess 72 is also provided with a plurality of orifices 74 in communication with the passage 76. Orifices 74 provide vacuum for holding the components in the recesses 70 and 72 in axial alignment and also provide bursts of low pressure air at suitable intervals to remove any debris from the recesses.

In the preferred embodiment, channels or grooves 84 and 86 in mounting plate 12 provide communication to vacuum chamber 25 to provide vacuum to orifices 74 at the stations "S" and openings 85 and 87 in mounting plate 12 provide low pressure air to orifices 74, as illustrated in FIG. 17 with reference to the position of the transfer drums. Preferably, low pressure air is provided at about 4 barr and vacuum is provided at about 70 to 80 mbarr.

In the illustrated embodiment, each station also includes three abutment members 68, one for each of the modules to be assembled at that station. The abutment members 68, FIGS. 9 and 12, are bolted to brackets 69 slidably mounted to an end plate 39, 40, and are movable axially relative to the spindles 44. Each abutment member 68 is spring-biased by spring 96 (FIG. 12), and is held retracted by a latch 90 engaged at 92 with extension 93 of bracket 69 (FIG. 11), and is released at appropriate times as will appear hereinafter. Latch 90 is pivotally mounted on a support member 91, which is mounted on the end plate 39, 40. See FIG. 11. Movement of the latch 90 is effected by engagement of a cam follower 100 mounted thereon with the profile cam surface 26 at the end of the cam sleeve 22.

In operation, as the assembly drum 27 rotates, a jacket segment A"is placed in a recess 70 FIG. 9), preferably by transfer drum D1. Due to the action of coupling member 64, following cam groove 24, and support arms 78, the clamp 66 is moved relative to the carriage 60 toward the spindle 44 to enclose the jacket segment "A" in recess 70. Thereafter, the clamp and carriage move in unison toward the rotating spindle due to the action of coupling member 64 following cam groove 24, to impale the jacket segment "A", restrained by retaining member 67, on the spindle 44. At this position, an aerosol generating cartridge "B" (FIG.2) is placed on the carriage in the recess 72, preferably by transfer drum D2 (FIG. 8). Following deposit of the cartridge "B" on the carriage, the abutment member 68 is released by the latch 90, due to the contour of cam surface 26, so that the abutment member is moved into engagement with the cartridge "B" and pushes it against jacket segment "A". See FIG. 12.

Movement of the clamp 66, together with the carriage 60, away from the spindle 44, as effected by coupling member 64 in combination with cam groove 24, withdraws jacket segment "A" and the pierced rod of tobacco 2 from the spindle and, with the aid of abutment member 68, impales the jacket segment "A" on the cartridge "B" disposing the capsule 5 within rod 2 and the fuel element 7 within sleeve 3 as shown in FIG. 3. During this movement, the plastic tube support member for sleeve 3 is held between capsule 5 and the shoulder 45 on the conical tip 46 of spindle 44, and is eventually ejected from sleeve 3 by passage through the pierced tobacco rod 2. Retaining member 67 has a hole 71 of sufficient size to permit the cartridge "B" to pass through and to restrain axial movement of jacket segment "A" when it is impaled on the spindle. Further movement of the clamp 66 and carriage 60 relative to the abutment member 68 removes clamp 66 from the resulting aerosol generating module "M" (FIG. 3 and reengages the latch 90 with the abutment member 68. The aerosol generating module "M" is then removed from the carriage by disengagement of the vacuum and transfer to transfer drum D3 (FIG. 8).

FIGS. 15-A to 15-H and 16-A through 16-O schematically depict the sequence of operation of the stations on assembly drum 27. FIGS. 15-A to 15-H diagramatically show the interaction of carriages 60.1 with cam surfaces 24.1 and 26.1 and the relative movements of the carriages 60.1, the clamps 66.1 and the abutment members 68.1. FIGS. 16-A through 16-O diagramatically show the movements of clamps 66.1, carriages 60.1 and abutment members 68.1 for the illustrated preferred embodiment which makes three aerosol generating modules at each station. These figures are presented solely for the purpose of illustrating relative movements and relative positions of the various parts of the carriages as shown.

FIGS. 15-A and 16-A show the clamp 66.1 displaced away from the spindles, for loading jacket segments "A". At this position, the recesses 70.1 on the carriage 60.1 are exposed. Jacket segments "A", preferably comprising a rod of tobacco, the sleeve of insulating fibers and the support tube, are now deposited in the recess 70.1, as shown in FIGS. 15-B and 16-B, in alignment with the axis of the spindles 44.1. The clamp 66.1 is now moved by the arm 78.1, by movement of coupling member 64.1 in conjunction with cam follower 62.1 following cam groove 24.1, as as shown in FIG. 15-C, to a position to enclose the jacket segments "A" in recesses 70.1. See FIGS. 16-C and D.

Following movement of the clamp relative to enclosing segments A, the carriage 60.1 is moved toward the spindles, by means of coupling member 64.1 and cam follower 62.1 in conjunction with cam groove 24.1. Carriage 60.1 carries with it jacket segments "A", enclosed by the clamp 66.1, to a position to impalethe jacket segments on the rotating spindles 44.1, as shown in FIGS. 15-D, 16-E and 16-F. At this position (FIGS.

15-D and 16-F), the recesses 72.1 are exposed between the clamp 66.1 and the abutment members 68.1.

The cartridges "B", comprising the capsule and fuel element, are now deposited between the clamp 66.1 and the abutment members 68.1 (FIG. 15-E and 16-G) with the fuel elements facing abutment members 68.1. The abutment members are then released by retraction of the latch 90.1 through the action of cam follower 100.1. Thus the spring biased abutment embers move into engagement with the cartridges "B" and presses the latter into engagement with jacket segments "A" (FIG. 15-F and 16-H).

Now the carriage 60.1 and clamp 66.1 are moved away from the spindles, which withdraws the jacket segments A from the spindles, expels the tubes 4 after passing through the openings in the tobacco rods, and impales the jacket segments "A" on the cartridge B" (FIG. 15-G, 16-I to J). Finally, the carriage 60.1 and clamp 66.1 are moved to their initial positions, as shown in FIG. 15-H and 16-K to 16-O, to free the composite structures "M" for pickoff, and to reengage latch 90.1.

Thus, in sequence, the aforesaid apparatus operates to pierce a rod of tobacco, one end of which been attached to a sleeve of insulating fibers disposed about a plastic tube, to form a longitudinal passage through the rod of tobacco corresponding to the inside diameter of the sleeve, and thereafter insert an aerosol generating cartridge into the formed passage and the sleeve.

It should be understood that the present disclosure is for the purpose of illustration only and the invention includes all modifications or improvements which are within the scope of the appended claims. The invention is not limited by particular materials, which are described only for purposes of illustration. For example, other materials may be used to form the jacket segment in place of tobacco and glass fibers, such as other fibrous materials and/or non-fibrous materials. Materials other than fibrous materials may also be used to form the sleeve. Other configurations of the aerosol generating cartridge may be employed.

It should also be understood that those skilled in the art, upon considering the present disclosure including the drawings, can readily modify the apparatus to insert cartridges in a sleeve (i.e. without a spindle), to make any number of aerosol generating modules simultaneously at each station, etc. As aforesaid, the configuration of the apparatus can be modified to perform the operations on endless linear belts, on rotary tables, or other known configurations.

What is claimed is:

1. Apparatus for making an aerosol generating module, the apparatus comprising jacket holding means for holding a jacket segment, cartridge holding means for holding an aerosol generating cartridge, and insertion means for inserting the aerosol generating cartridge into the jacket segment, wherein the jacket segment comprises a sleeve of insulating material preformed about a tubular member, and wherein the insertion means includes means for ejecting the tubular member from the sleeve.

2. The apparatus of claim 1 wherein the jacket holding means is in axial alignment with the cartridge holding means.

3. The apparatus of claims 1, 11, 12, 13, 14, 15, 16, 17, 18 or 2 further comprising support means carrying the jacket holding means and the cartridge holding means, and means cooperating with the jacket holding means for restraining movement of the jacket segment during insertion.

4. The apparatus of claim 3 wherein the insertion means comprises an abutment member proximate the cartridge holding means, and means for effecting relative movement between the support means and the abutment member to insert the cartridge into the jacket segment.

5. The apparatus of claim 3 wherein the insertion means comprises an abutment member proximate the cartridge holding means and means for moving the support means toward the abutment member to effect the insertion of the cartridge into the jacket segment.

6. The apparatus of claim 5 further comprising means for restraining movement of the abutment member while the support means is moving toward the abutment member to effect insertion of the cartridge into the jacket.

7. The apparatus of claim 3 wherein the jacket holding means comprises a first recess structured to receive the jacket segment, and the cartridge holding means comprises a second recess adjacent to the first recess and structured to receive the cartridge, the recesses being in axial alignment for insertion of the cartridge into the jacket segment.

8. The apparatus of claim 7 wherein the insertion means comprises an abutment member proximate the cartridge holding means, and means for effecting relative movement between the slidable support means and the abutment member to insert the cartridge into the jacket segment.

9. The apparatus of claim 8 wherein the abutment member is structured to be received in the second recess.

10. The apparatus of claim 9 further comprising means for releasably restraining movement of the abutment member while the support member is moving relative to the abutment member to effect insertion of the cartridge into the jacket.

11. Apparatus for making an aerosol generating module, the apparatus comprising jacket holding means for holding a jacket segment, cartridge holding means for holding an aerosol generating cartridge, insertion means for inserting the aerosol generating cartridge into the jacket segment; and passage forming means for forming a passage lengthwise through at least a portion of the jacket segment.

12. The apparatus of claim 11, further comprising means for ejecting a support member from within the jacket segment.

13. The apparatus of claim 11 wherein the passage forming means comprises a passage forming member, the apparatus further comprising means for withdrawing the passage forming member from the jacket segment and simultaneously inserting the aerosol generating cartridge into the jacket segment.

14. The apparatus of claim 13, further comprising means for ejecting a support member from within the jacket segment.

15. The apparatus of claim 14 wherein the means for simultaneously withdrawing the passage forming member and inserting the cartridge includes the means for ejecting the support member.

16. The apparatus of claim 11 further comprising means for ejecting a support member from within the jacket segment.

17. The apparatus of claim 16 further comprising means for simultaneously inserting the aerosol generating cartridge into the jacket segment while the support member is being ejected.

18. The apparatus of claim 11 wherein the jacket segment comprises a sleeve of insulating material preformed about a tubular member, and wherein the insertion means includes means for ejecting the tubular member from the sleeve.

19. The apparatus of claim 11, 12, 13 or 14 wherein the jacket segment comprises a rod of tobacco material and the passage forming means forms a passage lengthwise in the rod.

20. The apparatus of claim 11, 12, 13 or 14 wherein the jacket segment comprises a sleeve portion having insulating material preformed about a support member and a rod portion having fibrous material and the passage forming means forms a longitudinal passage in the rod portion.

21. The apparatus cf claim 11 or 13, wherein the passage forming means includes a spindle and the apparatus further comprises a slidable support means which carries the jacket holding means and cartridge holding means, the jacket holding means being mounted proximate to the passage forming means, the jacket holding means comprises a first recess shaped to receive the jacket segment, and the cartridge holding means comprises a second recess adjacent to the first recess and shaped to receive the cartridge, the recesses being in axial alignment for insertion of the cartridge into the jacket segment, the jacket holding means further including means for restraining movement of the jacket segment during passage formation and insertion, the insertion means comprises an abutment member proximate the cartridge holding means, means for moving the slidable support means toward the spindle to effect formation of the passage in the jacket segment, and means for moving the support means away from the spindle cooperating with means for restraining movement of the abutment member while the support means is moving away from the spindle to withdraw the jacket segment from the spindle, engage the cartridge with the abutment member, and insert the cartridge into the jacket segment.

22. The apparatus of claim 21 wherein the spindle, the means for moving the support means away from the spindle, and the means for restraining movement of the abutment member comprise a means for ejecting a support member from within the jacket segment.

23. The apparatus of claim 1, 2, 3, 4, 5, 6, 7, or 8, wherein the jacket holding means and cartridge holding means are mounted adjacent each other on a support means, the jacket holding means includes a means for restraining movement of the jacket segment during insertion, the insertion means comprises an abutment member adjacent the cartridge holding means, and the apparatus further comprises means for effecting relative motion between the abutment member and the support means to effect insertion of the cartridge into the jacket segment.

24. Apparatus for assembling first and second components of a smoking article comprising a spindle, an abutment member spaced from and in alignment with the axis of the spindle, a support means disposed between the spindle and abutment member embodying aligned recesses for supporting the first and second components in alignment between the spindle and abutment member, the abutment member being movable in unison with the support means and relative thereto, mean for restraining movement of the first component in its recess, means for effecting movement of the support means and abutment member in unison in a first direction toward the spindle to impale the first component on the spindle to form a longitudinal passage therein, means operable to inhibit retraction of the abutment member after the first component has been impaled on the spindle, the means for effecting movement of the support means being operable to thereafter effect movement of the support means away from the spindle and toward the abutment member to withdraw the first component from the spindle, engage the second component with the abutment member and move the first component relative to the second component to impale the first component on the second component.

25. Apparatus according to claim 24 wherein the support means is provided with aligned first and second half-circular recesses of different radii for receiving the first and second components in alignment.

26. Apparatus according to claim 25 wherein the abutment member is of a cross section to be received within the half-circular recess having the smaller radius.

27. Apparatus according to claim 24 wherein the first component comprises a rod of tobacco, at one end of which there is a sleeve disposed about a support member and wherein movement of the first component onto the second component expels the support member from the sleeve.

28. Apparatus according to claim 27 wherein the second component comprises a capsule containing an aerosol forming material and having at one end thereof a fuel element and wherein the second component is disposed on the support means in a position such that movement of the support means toward the abutment member disposes the first component onto the second component with the sleeve around the fuel element and the tobacco around the capsule.

29. Apparatus according to claim 24 wherein the support means and abutment member are mounted on a carriage and a stop member is fixed to the carriage, the abutment member being engageable with the stop member so that movement of the carriage toward the spindle moves the abutment member in unison therewith, and wherein there is a latch member engageable to constrain movement of the abutment member relative to the carriage when the carriage moves away from the spindle.

30. Apparatus according to claim 29 wherein the latch member is disengageable from the abutment member to permit the abutment member to be returned to its initial position into engagement with the stop member.

31. Apparatus according to claim 24 wherein the spindle has a conical tip and there is means for rotating the spindle about its longitudinal axis.

32. Apparatus for assembling first and second components of a smoking article, the apparatus comprising a spindle, an abutment member spaced from and in axial alignment with the spindle, a support means between the spindle and abutment member, means for restraining the first component on the support means in axial alignment with the spindle, a recess on the support means for receiving a second component in axial alignment with the spindle and with the first component, means for effecting movement of the support means and abutment member in unison relative to the spindle in a first direction toward the spindle to move the first component toward the spindle to impale the first component on the spindle to form a passage lengthwise therein, means engageable to inhibit movement of the abutment member away from the spindle after the first component has been impaled on the spindle, the means for effecting movement of the support means being operable thereafter to effect movement of the support means away from the spindle to withdraw the first component from the spindle and to insert the second component at least partially within said first component.

33. Apparatus for assembling first and second components of a smoking article, the apparatus comprising a spindle, an abutment member spaced from and in concentric alignment with the spindle, a support means between the spindle and abutment member, the support means being movable in a first direction toward the spindle and in a second direction away from the spindle relative to the abutment member, restraining means movable with the support means for restraining movement of a first component on the support means for movement therewith in the first direction onto the spindle to form a passage lengthwise in the first component, means on the support means for holding a second component deposited thereon in alignment with the first component between the first component and the abutment member, and wherein the support means together with the restraining means are moved in a second direction to move the second component into engagement with the abutment member and the first component relative to the second component to dispose the first component on the second component, and means for thereafter releasing the restraining means to remove the assembled first and second components from the support means.

34. Apparatus for making components of smoking articles, the apparatus comprising a spindle, an abutment member spaced from and in concentric alignment with the spindle, a support means between the spindle and abutment member for supporting a first and a second component in axial alignment between the spindle and abutment member, means for moving the support means in a direction to impale the first component on the spindle to form a passage longitudinally therein and thereafter to withdraw the pierced first component from the spindle and impale it on the second component.

35. Apparatus for making components of smoking articles, the apparatus comprising a spindle, an abutment member in spaced axial alignment therewith, a support means for supporting (a) an elongate segment of fibrous material, at one end of which there is a sleeve, and (b) a cartridge, at one end of which there is a fuel element, between and in axial alignment with the spindle and the abutment member with the elongate segment proximate the spindle and the cartridge proximate the abutment member, means engageable to restrain movement of the abutment member relative to the support means, and means for moving the support means with abutment member in a first direction to impale the elongate module of fibrous material on the spindle to form a longitudinal passage therein and thereafter to move the support means in a second direction away from the spindle relative to the restrained abutment member to impale the pierced segment of fibrous material on the cartridge.

36. Apparatus according to claim 35 wherein the segment of fibrous material comprises a rod of tobacco material and a sleeve of insulating material surrounding a support member, and wherein the support member is removed from the sleeve as the rod is moved away from the spindle.

37. Apparatus for making modules for smoking articles, the apparatus comprising: a plurality of movably mounted stations, each station comprising jacket receiving means for receiving at least one jacket segment, clamp means cooperating with the receiving means to restrain the jacket segment in a predetermined position, and cartridge holding means for receiving and holding at least one cartridge; and means for inserting the cartridge into the jacket segments, the clamp means cooperating with the jacket receiving means during insertion.

38. The apparatus of claim 37 wherein the stations are mounted on a rotatable member.

39. Apparatus for making modules for smoking articles, the apparatus comprising: a plurality of movably mounted stations, each station comprising jacket holding means for receiving and holding at least one jacket segment and cartridge holding means for receiving and holding at least one cartridge; and means for inserting the cartridges into the jacket segments; and further comprising passage forming means for forming a passage lengthwise through at least a portion of each jacket.

40. The apparatus of claim 39 further comprising means for ejecting a support member from within the jacket segment.

41. The apparatus of claim 39 wherein the passage forming means comprises a passage forming member, each station further comprising means for withdrawing the passage forming member from each jacket segment and simultaneously inserting an aerosol generating cartridge into the jacket segment.

42. The apparatus of claim 41 further comprising means for ejecting a support member from within the jacket segment.

43. The apparatus of claim 42 wherein the means for simultaneously withdrawing the passage forming member and inserting the cartridge includes the means for ejecting the support member.

44. The apparatus of claim 37 or 38 further comprising means for ejecting a support member from within the jacket segment.

45. The apparatus of claim 44 wherein each station further comprises means for simultaneously inserting an aerosol generating cartridge into the jacket segment while the support member is being ejected.

46. The apparatus of claim 37 or 38 wherein at each station the jacket receiving is in axial alignment with the cartridge holding means.

47. The apparatus of claims 37 or 38 wherein each station further comprises a support means having thereon the jacket receiving means and the cartridge holding means.

48. The apparatus of claim 47 wherein the insertion means comprises: an abutment member proximate the cartridge holding means; and means for effecting relative movement between the support means and the abutment member to insert the cartridge into the jacket segment.

49. The apparatus of claim 47 wherein the insertion means comprises an abutment member proximate the cartridge holding means and means for moving the support means toward the abutment member to effect the insertion of the cartridge into the jacket segment.

50. The apparatus of claim 49 further comprising means for restraining movement of the abutment member while the support means is moving toward the abutment member to effect insertion of the cartridge into the jacket.

51. The apparatus of claim 47 wherein each station comprises passage forming means for forming a passage lengthwise through at least a portion of each jacket segment.

52. The apparatus of claim 37 or 38 wherein each station further comprises: a support means having fixed thereto the jacket receiving means and the cartridge holding means; and wherein the insertion means comprises: an abutment member proximate the cartridge holding means; and means for effecting relative movement between the support means and the abutment member to insert the cartridge into the jacket segment.

53. The apparatus of claim 52 wherein each station comprises passage forming means for forming a passage lengthwise through at least a portion of each jacket segment.

54. Apparatus for making modules for smoking articles, the apparatus comprising: a plurality of movably mounted stations, each station comprising jacket holding means for receiving and holding at least one jacket segment and cartridge holding means for receiving and holding at least one cartridge; and means for inserting the cartridges into the jacket segments; said apparatus further comprising:

a spindle for forming a passage lengthwise through at least a portion of the jacket segment;

a slidable support means which carries the jacket holding means and cartridge holding means, the jacket holding means being mounted proximate to the passage forming means;

the jacket holding means comprises a first recess shaped to receive a jacket segment, and the cartridge holding means comprises a second recess adjacent to the first recess and shaped to receive a cartridge, the recesses being in axial alignment with the spindle for formation of the passage and with each other for insertion of the cartridge into the jacket segment;

the jacket holding means further including means for restraining movement of the jacket segment during passage formation and insertion;

the insertion means comprises an abutment member proximate the cartridge holding means;

means for moving the slidable support means toward the spindle to effect formation of the passage in the jacket segment; and means for moving the support means away from the spindle, cooperating with means for restraining movement of the abutment member while the support jacket segment from the spindle, engage the cartridge with the abutment member, and insert the cartridge into the jacket segment.

55. The apparatus of claim 54 wherein the spindle, the means for moving the support means away from the spindle, and the means for restraining movement of the abutment member comprise a means for ejecting a support member from within the jacket segment.

56. The apparatus of claim 37 or 38 wherein the jacket receiving means and cartridge holding means are mounted adjacent each other on a support means, the insertion means comprises an abutment member adjacent the cartridge holding means, and the apparatus further comprises means for effecting relative motion between the abutment member and the support means to effect insertion of the cartridge into the jacket segment.

57. The apparatus of claim 56 wherein the apparatus comprises passage forming means for forming a passage lengthwise through at least a portion of the jacket segment.

58. The apparatus of claim 57 wherein the passage forming means comprises a passage forming member and each station comprises means for withdrawing the passage forming member from the jacket segment and simultaneously inserting the aerosol generating cartridge.

59. Apparatus for making modules for smoking articles, the apparatus comprising: a plurality of movably mounted stations, each station comprising jacket holding means for receiving and holding at least one jacket segment and cartridge holding means for receiving and holding at least one cartridge; and means for inserting the cartridges into the jacket segments;

wherein the jacket segment comprises a sleeve of insulating material preformed about a tubular member and wherein the insertion means includes means for ejecting the tubular member from the sleeve.

60. Apparatus for making modules for smoking articles, the apparatus comprising: a plurality of movably mounted stations, each station comprising jacket holding means for receiving and holding at least one jacket segment and cartridge holding means for receiving and holding at least one cartridge; and means for inserting the cartridges into the jacket segments;

wherein the jacket segment comprises a rod of tobacco material and each station comprises passage forming means for forming a passage lengthwise in the rod.

61. Apparatus for making aerosol generating modules for smoking articles, said apparatus comprising:

jacket supply means for supplying jacket segments and cartridge supply means for supplying aerosol generating cartridges to each of a plurality of movable mounted stations in seriatim;

each station comprising: jacket receiving means for receiving jacket segments, clamp means cooperating with the receiving means to restrain the jacket segment in a predetermined position; cartridge holding means for receiving and holding aerosol generating cartridges; and means for inserting the cartridges into the jacket segments, thereby forming aerosol generating modules; and means for removing the aerosol generating modules from each station, in seriatim.

62. The apparatus of claim 61 wherein the stations are mounted on a rotatable member.

63. The apparatus of claim 62 wherein the jacket supply means comprise a rotatable member.

64. The apparatus of claim 62 wherein the cartridge supply means comprises a rotatable member.

65. The apparatus of claim 61 further comprising means for forming a passage lengthwise through at least a portion of the jacket segment.

66. Apparatus for the manufacture of a smoking article, the apparatus comprising a plurality of stations, each station comprising a spindle; an abutment member disposed in spaced alignment with the spindle; a carriage structured to support a first component comprising a jacketed rod of tobacco, at one end of which there is a sleeve of non-combustible material formed around a support member, in alignment with the spindle and the abutment member; and means for effecting movement of the carriage in a direction toward the spindle to pierce the jacketed rod of tobacco; means for supporting a second component comprising an aerosol generating cartridge, at one end of which there is a fuel element, on the carriage between the first component and the abutment member, for constraining movement of the second component relative to the carriage; and means for moving the carriage in a direction away from the spindle to withdraw the first component from the spindle, impale it on the second component and expel the support member.

67. Apparatus for making modules for smoking articles, the apparatus comprising: a plurality of movably mounted stations, each station comprising jacket receiving means for receiving at least one jacket segment, clamp means cooperating with the receiving means to restrain the jacket segment in a predetermined position; and means for inserting cartridges into the jacket segment the clamp means cooperating with the jacket receiving means during insertion.

68. The apparatus of claim 68 wherein the stations are mounted on a rotatable member.

69. Apparatus for making modules for smoking articles, the apparatus comprising: a plurality of movably mounted stations, each station comprising jacket holding means for receiving and holding at least one jacket segment; and means for inserting cartridges into jacket segment; said apparatus further comprising means for forming a passage lengthwise through at least a portion of the jacket segment.

70. The apparatus of claim 69, further comprising means for ejecting a support member from within the jacket segment.

71. The apparatus of claim 69 wherein the passage forming means comprises a passage forming member, the apparatus further comprising means for withdrawing the passage forming member from each jacket segment and simultaneously inserting an aerosol generating cartridge into the jacket segment.

72. The apparatus of claim 71, further comprising means for ejecting a support member from within the jacket segment.

73. The apparatus of claim 72 wherein the means for simultaneously withdrawing the passage forming member and inserting the cartridge includes the means for ejecting the support member.

74. The apparatus of claim 67 wherein the apparatus further comprises means for ejecting a support member from within the jacket segment.

75. The apparatus of claim 74 wherein the apparatus further comprises means for simultaneously inserting an aerosol generating cartridge into the jacket segment while the support member is being ejected.

76. The apparatus of claim 67, wherein each station holds a plurality of jacket segments and the apparatus comprises means for simultaneously inserting a cartridge into each jacket segment.

77. The apparatus of claim 76, further comprising means for simultaneously forming a passage lengthwise through at least a portion of each of the jacket segments.

78. The apparatus of claim 77, further comprising means or simultaneously ejecting a support member from within each of the jacket segments.

79. Apparatus for making an aerosol generating module, the apparatus comprising:

jacket holding means for holding a jacket segment, the jacket segment comprising a support member, cartridge holding means for holding an aerosol generating cartridge, ejection means for ejecting the support member from within the jacket segment; and insertion means for inserting the aerosol generating cartridge into the jacket segment.

80. Apparatus for making an aerosol generating module, the apparatus comprising:

jacket holding means for holding a jacket segment, the jacket segment comprising a support member, cartridge holding means for holding an aerosol generating cartridge, insertion means for inserting the aerosol generating cartridge into the jacket segment; and ejection means for ejecting the support member from within the jacket segment;

the apparatus further comprising means for simultaneously inserting the aerosol generating cartridge into the jacket segment while the support member is being ejected.

* * * * *

UNITED STATES PATENT AND TRADEMARK OFFICE

CERTIFICATE OF CORRECTION

PATENT NO. : 5,088,507

DATED : February 18, 1992

INVENTOR(S) : Max N. Baker et al

It is certified that error appears in the above-indentified patent and that said Letters Patent is hereby corrected as shown below:

On the title page, in item [75] Inventors: after "Clark" insert --Robert A. Emken--. After "N.C." insert --Gerhard Hensgen, Neuengammer, Alfred Schubert, Reinbek, both of Fed. Rep. of Germany--.

Col. 5, line 63, "rom" should be --from--.

Col. 18, line 49, after "receiving" insert --means--.

Signed and Sealed this

Seventh Day of September, 1993

Bruce Lehman

*Attest:*

BRUCE LEHMAN

*Attesting Officer*

*Commissioner of Patents and Trademarks*